US006863476B2

(12) United States Patent
Malkoski

(10) Patent No.: US 6,863,476 B2
(45) Date of Patent: Mar. 8, 2005

(54) MOBILE SYSTEM FOR MANUFACTURING AND INSTALLING REINFORCING MEMBERS

(75) Inventor: Michael Malkoski, Sudbury (CA)

(73) Assignee: Langford Industries, Ltd., Sudbury (CA)

( * ) Notice: Subject to any disclaimer, the term of this patent is extended or adjusted under 35 U.S.C. 154(b) by 0 days.

(21) Appl. No.: 10/363,193

(22) PCT Filed: Sep. 4, 2001

(86) PCT No.: PCT/CA01/01248

§ 371 (c)(1),
(2), (4) Date: Mar. 4, 2003

(87) PCT Pub. No.: WO02/20945

PCT Pub. Date: Mar. 14, 2002

(65) Prior Publication Data

US 2003/0180098 A1 Sep. 25, 2003

(30) Foreign Application Priority Data

Sep. 5, 2000 (CA) ..... 2318609

(51) Int. Cl.[7] ..... E21D 20/00

(52) U.S. Cl. ..... 405/302.2; 405/259.1; 405/303; 405/288

(58) Field of Search ..... 405/259.1, 288, 405/302.1, 302.2, 302.3, 303

(56) References Cited

U.S. PATENT DOCUMENTS

| | | | | |
|---|---|---|---|---|
| 4,003,233 A | | 1/1977 | Stange | |
| 4,079,592 A | | 3/1978 | Eakin | |
| 4,289,427 A | | 9/1981 | Rolston | |
| 4,589,803 A | | 5/1986 | Totten, III | |
| 4,790,129 A | | 12/1988 | Hutchins | |
| 5,419,660 A | * | 5/1995 | Marquis | 405/259.1 |
| 5,560,740 A | * | 10/1996 | Castle et al. | 405/259.6 |
| 5,603,589 A | | 2/1997 | Von Allmen et al. | |
| 5,816,750 A | * | 10/1998 | Steffenino | 405/302.3 |
| 6,030,151 A | * | 2/2000 | Woolnough et al. | 405/302.2 |
| 6,039,509 A | | 3/2000 | Locotos | |

FOREIGN PATENT DOCUMENTS

| | | |
|---|---|---|
| DE | 4203740 A1 | 8/1993 |
| EP | 0516140 A1 | 12/1992 |
| FR | 2545150 A1 | 11/1984 |
| GB | 2294658 A | 5/1996 |
| GB | 2323648 A | 9/1998 |
| WO | WO 9315279 A1 | 8/1993 |

* cited by examiner

*Primary Examiner*—Frederick L. Lagman
(74) *Attorney, Agent, or Firm*—Gardner Groff, P.C.

(57) ABSTRACT

A mobile system for manufacturing and installing rock reinforcing members in mining and tunnel construction applications where a plurality of holes are drilled into the rock and each hole receives a reinforcing member and grout. The reinforcing member can be steel strand or some other suitable material. The system has a plurality of cooperating devices, all mounted to a mobile self-propelled platform. The devices comprise a spool of reinforcing material, a motivating device for drawing material from of the spool through the system, a measuring device, a crimping device to give the steel strands a corrugated shape, an articulating arm with a guide head to guide the material into the drill hole and a cutter to cut the material into strands of desired length. A plurality of strands can be installed in a given drill hole. The system also includes apparatus for grouting the drill holes using either a cementacious grout or a polyester resin grout. Methods of making and grouting the reinforcing member are disclosed.

64 Claims, 27 Drawing Sheets

MOBILE SYSTEM FOR MANUFACTURING AND INSTALLING REINFORCING MEMBERS

BACKGROUND

1. Cross Reference to Related Applications

This application is entitled to the benefit of Canadian provisional patent application 2,318,609 filed on Sep. 5, 2000.

2. Field of the Invention

This invention relates to apparatus and methods for stabilizing rock in tunnelling and mining operations and more specifically relates to a mobile system for manufacturing and installing reinforcing members.

3. Discussion of the Prior Art

Examples of exiting rock stabilizing apparatus can be found in U.S. Pat. Nos. 3,942,329; 5,785,463; 5,954,455; and, 5,603,589. However, all of these patents describe apparatus that are manufactured off-site and therefore must be transported to the work-site for installation. This adds significantly to the cost of rock-reinforcing operations because it increases the amount of labour and time necessary for rock-reinforcing operations. Furthermore, when manufacturing rock-reinforcing apparatus off-site, it is difficult to customize the length, tensile strength and yield of a plurality of reinforcing members to suit various rock-reinforcing applications. The previous patents fail to disclose a system whereby the reinforcing members can be fabricated, installed and grouted at the work site within a construction tunnel or mine tunnel in a cost-effective and time-efficient manner. Thus, there is a need for a complete manufacturing system that can be taken to a work site that is capable of quickly manufacturing and installing customized reinforcing members in rock formations.

OBJECTS OF THE INVENTION

It is an object of the present invention to overcome the deficiencies of the prior art. It is a further objective to provide a mobile system for manufacturing and installing customized reinforcing members that can be transported to a work site.

SUMMARY OF THE INVENTION

The objects of the present invention are satisfied through the provision of a mobile system for manufacturing and installing reinforcing members. The system comprises a mobile platform adapted for movement within a tunnel. Mounted to the platform are means for manufacturing and installing customized reinforcing members. The mobile platform can be towed or it can be self-propelled. Generally a hydraulic system is provided to propel and operate the system. The hydraulic system is powered by air, electricity or a diesel engine. The means for manufacturing the reinforcing members comprise a source of a suitable reinforcing material such as steel strand or pre-formed fibreglass strand. The source is a spool of material that is mounted to a storage rack on the platform. Additional spools can be stored on the platform. The material is drawn off of the roll by a pulling mechanism. The pulling mechanism also feeds the material to a crimping device. The crimping device gives the strand a desired corrugated profile. The corrugated profile is adjusted to suit a desired yield strength of the reinforcing members. The greater the number of corrugations the greater the linear distance the grout has to fix the member and the greater the tensile yield strength of the member. A measuring device is included to measure the length of strand pulled off of the roll. In this way the operator knows how much strand is being directed in to a particular drill hole. The strand is guided into the drill hole by an articulating arm pivotally mounted to the platform. The arm is hydraulically motivated and capable of placing a guide head in proximity to the mouth of a drill hole. The guide head comprises a frame and guide funnel. A guide tube is mounted to the arm. The guide tube penetrates the frame of the guide head and directs the strand from the crimping device, up the arm and into the guide funnel. A predetermined length of corrugated material is fed into the drill hole. The material emerges from the guide tube in front of a cutting device. The cutting device cuts the strands into predetermined lengths and stacks them onto the guide head. Once the desired numbers of strands have been inserted into the drill hole, the hole is grouted. The system includes apparatus for grouting the hole. The grouting system is mounted to the platform. Alternatively, the grouting system can be in the form of a grouting pack dismountable from the platform. The grouting system comprises a reservoir of grouting material. In the case of a cementacious grout, the grout is mixed in the reservoir which is also a mixing chamber having mixing means. A pump pumps the grout through tubing into the drill hole. The tubing is guided into the drill hole by the guide head. Once the hole is grouted a wedge is inserted into the hole to hold the strands in place while the grout sets. If the grout is a polyester binary resin grout the system has two reservoirs once for each element of the binary resin. Two displacement pumps are provided, one for each reservoir. Two tubes are provided to direct the binary elements of the resin to the guide head. The two tubes meet below the guide head in a chamber. Exiting from the mixing chamber is a single tube that travels through the guide head and into the drill hole. Depending on the yield strength desired from the reinforcing member the resin grout may fill the entire drill hole for maximum yield strength. Such would be the case in a construction application where it is undesirable for the reinforced rock body to move any appreciable amount. However, in other applications, it may be desirable for the rock body to yield slowly. For example, in mining operation, it is desirable to prevent the phenomena known as "rock burst" which is a sudden failure rock without warning. Therefore, reinforcing members need to be designed to yield slowly and in a perceptible manner so that an operator can gauge the amount of yield in a rock body. This is accomplished by adjusting the corrugated profile of the reinforcing member. As well, the drill hole may be partially grouted with resin at its toe and collar.

Methods of installing and grouting a reinforcing member in a drill hole are also disclosed. Further objects and advantages of this invention will become apparent from a consideration of the following drawings, detailed description and claims.

DESCRIPTION OF THE INVENTION

Figure 1:
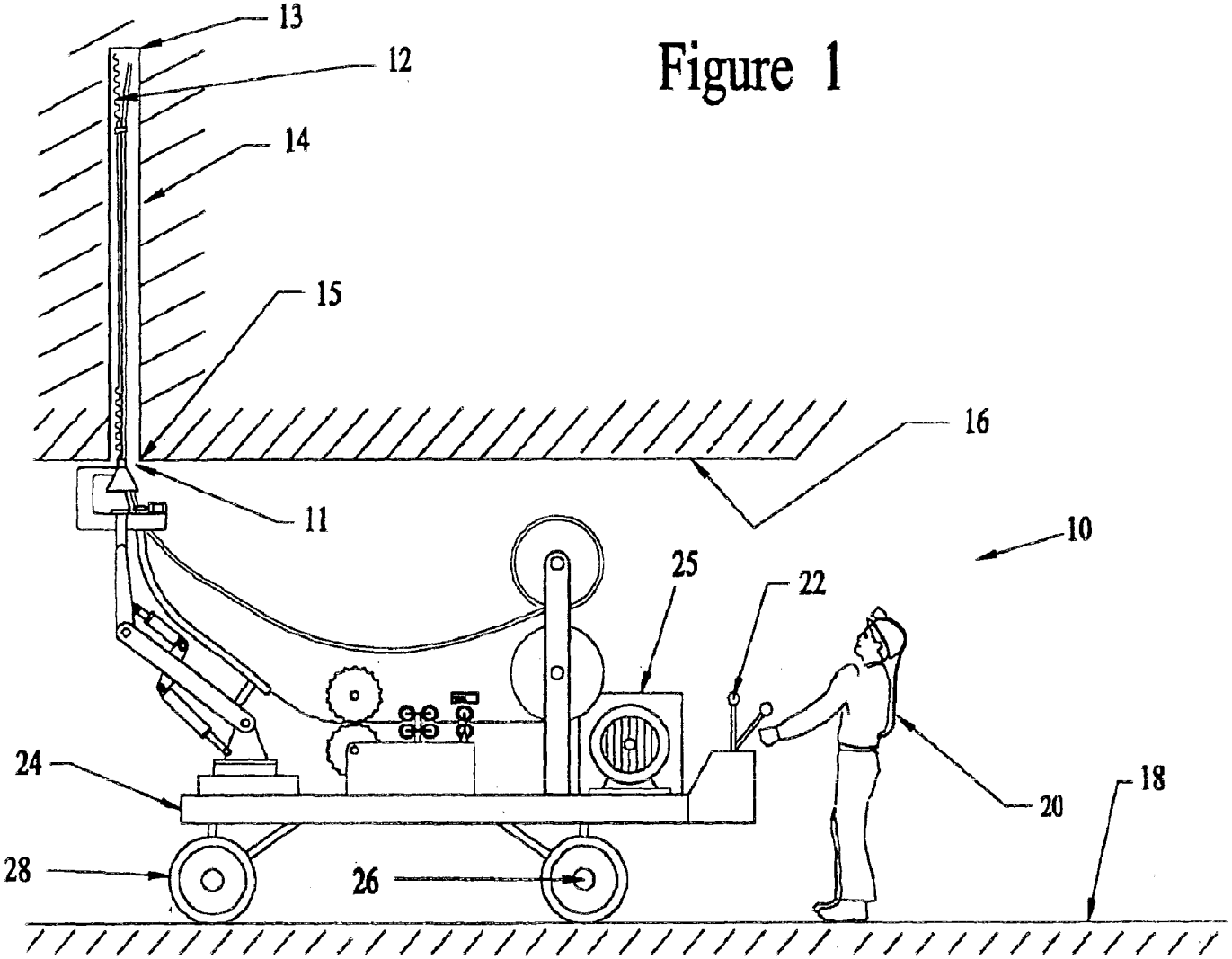
FIG. 1 is a side view of one embodiment of the invention.

Referring to FIG. 1 there is illustrated in side view one embodiment of the invention for a mobile system (10) for manufacturing and installing a reinforcing member (12) into a drill hole (14) drilled into a rock body (16) requiring support. The drill hole has a mouth (11), a toe (13) and a collar (15). The system is illustrated positioned in a tunnel (18) as might be found in mining or tunnelling construction operations. The system (10)is operable by an operator (20) by way of control panel (22). In this embodiment the control panel is shown fixed to the rear of the platform (24). However, it is understood by a person skilled in the art of such devices that the control panel may be a wired or wireless control panel detachable from the platform (24) for remote operation of the system. The platform (24) rides on at least two wheeled axles (26) that permit the platform to be moved. Wheels (28) may be road wheels to permit the platform to be towed or pushed in and out of the mine by a wheeled vehicle. Alternatively, the wheels (28) may be adapted to ride on tracks as might be found in mining or tunnelling operations. Alternatively, retractable steel wheels may also be included in the invention permitting travel over pre-existing rails. The platform is self-propelled. Power supply (25) is provided to drive axles (26) so that the platform can be moved from hole to hole and from work site to work site. As well, power supply (25) drives the various devices attached to the platform as further identified below. The power supply may be one of air over hydraulic; electric over hydraulic or diesel over hydraulic. The platform may be towed to the work site and then connected to a local electric or air supply to drive the system hydraulics. Alternatively, the air or electrical power supply may be slaved from the towing vehicle.

Figure 2:
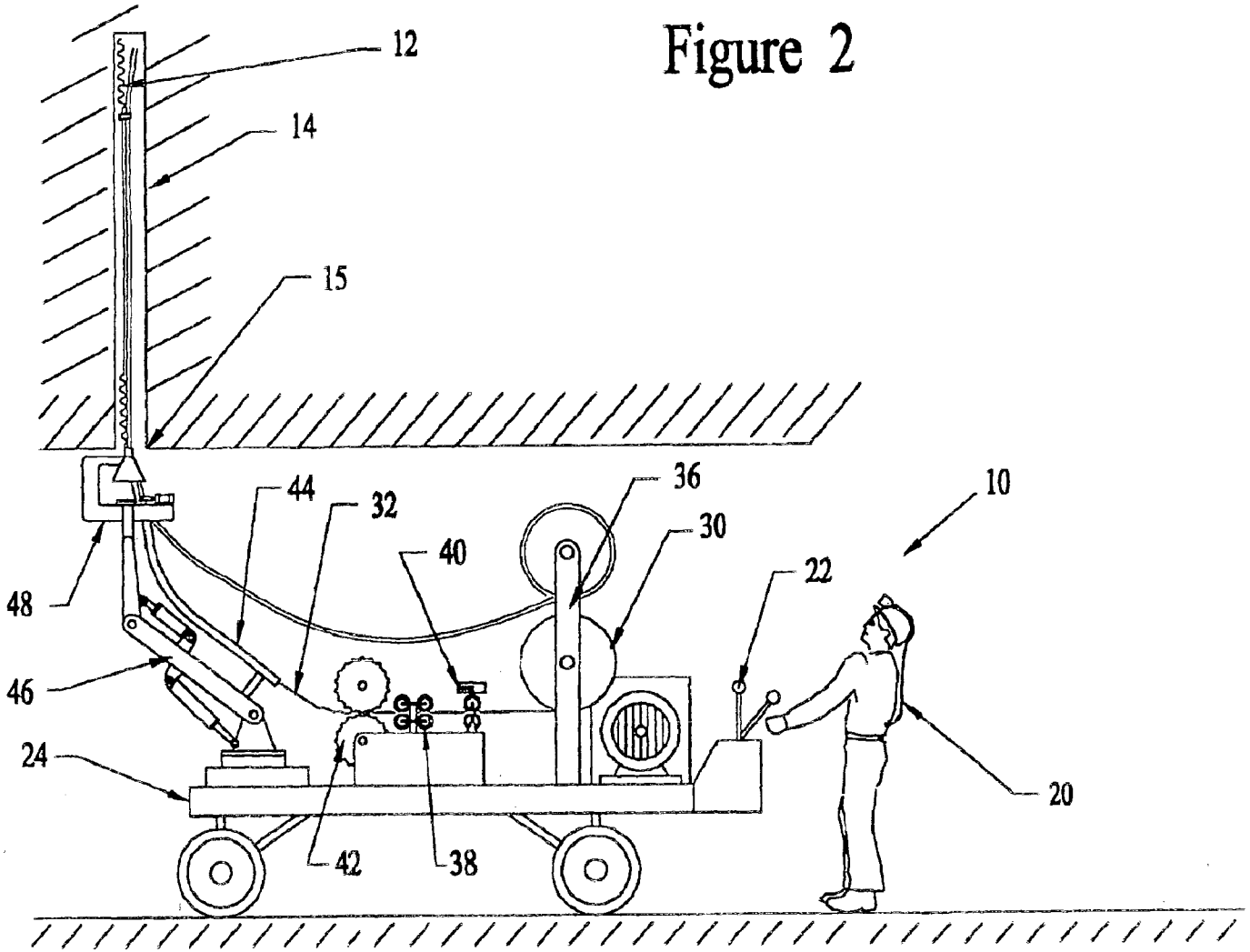
FIG. 2 is another side view of one embodiment of the invention.

Referring to FIG. 2, there is shown the same embodiment as in FIG. 1. Mounted to the platform (24) is apparatus for manufacturing and installing the reinforcing member (12) for installation into drill hole (14). A spool (30) of a continuous strand (32) of resilient tensile material is located on the platform. Spool (30) is detachably mounted to rack (36) fixed to the platform (24). In this embodiment the spool (30) of material (32) can be delivered directly from the manufacturer and mounted to the platform (24) without additional material handling. Additional spools may be stored on the platform either on the rack of the platform or on the floor of the platform. The material (32) may be steel wire strand of a predetermined diameter and tensile strength depending on the reinforcement requirements. The material may also be aluminium or other metals, Kevlar®, plastic, fibreglass or composite materials. Steel and other metallic substances are generally used when the reinforcing application is to be permanent or semi-permanent such as in tunnel construction or some mining application. In other types of mining operations the reinforcing members are temporary and the rock in which the reinforcing members are placed will be mined and processed in due course. In this situation non-metallic reinforcement material such as fibreglass is used. When the rock is blasted the fibreglass will breakdown and is easily crushed in mine crushers or drilled by drills without damaging the crusher or drill or creating a safety hazard as a metallic reinforcing member might.

Still referring to FIG. 2, the system (10) comprises a motivating device (38) to draw material (32) from the spool (30). A measuring device (40) for measuring the amount of material being drawn off the spool is also included. The measuring device may comprise a pair of opposed rollers in frictional engagement with the material that measures linear distances as a function of roller revolution. Alternatively, the measuring device may be opto-electronic. Output from the measuring device is fed back to the control panel (22) so that the operator (20) is aware of how much material is being placed into the drill hole (14). Spool (30), motivation device (38) and measuring device (40) are fixed in longitudinal alignment to the platform (24). Crimping device (42) is mounted to platform (24) in longitudinal alignment with measuring device (40) and motivation device (38). When metallic reinforcing material such as steel is used, it is desirable to press a corrugated shape in the material. This shape determines, in part, the yield strength of the reinforcing member. The more corrugations in the member means that the grout holding the member in the drill hole has a greater surface area over which to transfer stabilizing forces to the member. The reinforcing material (32) is fed into the crimping device. The crimping device presses a predetermined corrugated profile into the material (32). When non-metallic materials are used, such as fibreglass, the material will be delivered to the work site with the desired profile. Hence the crimping device may be engaged or disengaged by the operator (20) as required. In its disengaged position the non-metallic material will pass through the device unmolested. As well, when using metal strand, it is necessary to coordinate the operation of the motivating device (38) with the crimping device (42) to avoid kinking the material between the two devices. Therefore, there are logic connections between the motivating device (38) and the crimping device (42) to coordinate their operation. As well, the operator (20) may coordinate the operation of these two devices manually through control panel (22). Once the material leaves the crimping device (42) it is fed into a guide tube (44) that is fixed to articulating arm (46). Articulating arm (46) is pivotally mounted to the platform (24). The guide tube guides the material upwards along the arm to the guide head (48) mounted to the free end of the arm (46). The guide head is placed adjacent to the drill hole collar (15) and guides the reinforcing material (32) into the drill hole (14).

Figure 2A:
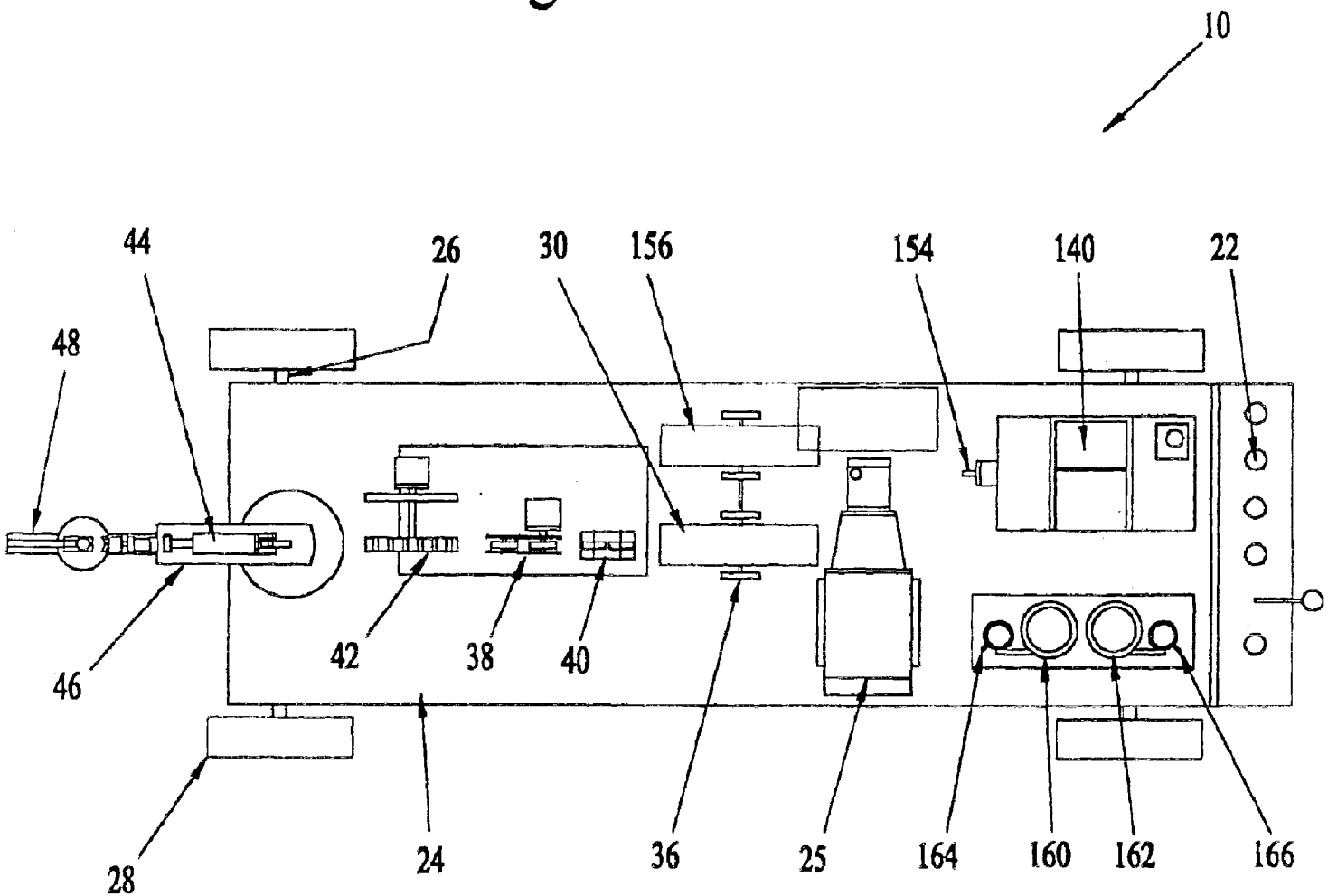
FIG. 2A is a top view of one embodiment of the invention.

Referring to FIG. 2A there is shown a top view of one embodiment of the invention (10) showing the relationship and location of the various devices. The system (10) is operable by an operator by way of control panel (22). In this embodiment the control panel is shown fixed to the rear of the platform (24). The platform (24) rides on at least two wheeled axles (26) that permit the platform to be moved. Wheels (28) mounted to the axles (26) may be road wheels to permit the platform to be towed or pushed in and out of the mine by a wheeled vehicle. Power supply (25) is provided to drive axles (26). As well, power supply (25) drives the various devices attached to the platform as further identified below. A spool (30) of a continuous strand of resilient tensile material is located on the platform. Spool (30) is detachably mounted to rack (36) fixed to the platform (24). Motivating device (38) draws material from the spool (30). A measuring device (40) for measuring the amount of material being drawn off the spool is also included. Spool (30), motivation device (38) and measuring device (40) are fixed in longitudinal alignment to the platform (24). Crimping device (42) is mounted to platform (24) in longitudinal alignment with measuring device (40) and motivation device (38). Once the material leaves the crimping device (42) it is fed into a guide tube (44) that is fixed to articulating arm (46). Articulating arm (46) is pivotally mounted to the platform (24). The guide tube guides the material upwards along the arm to the guide head (48) mounted to the free end of the arm (46).

Figure 3:
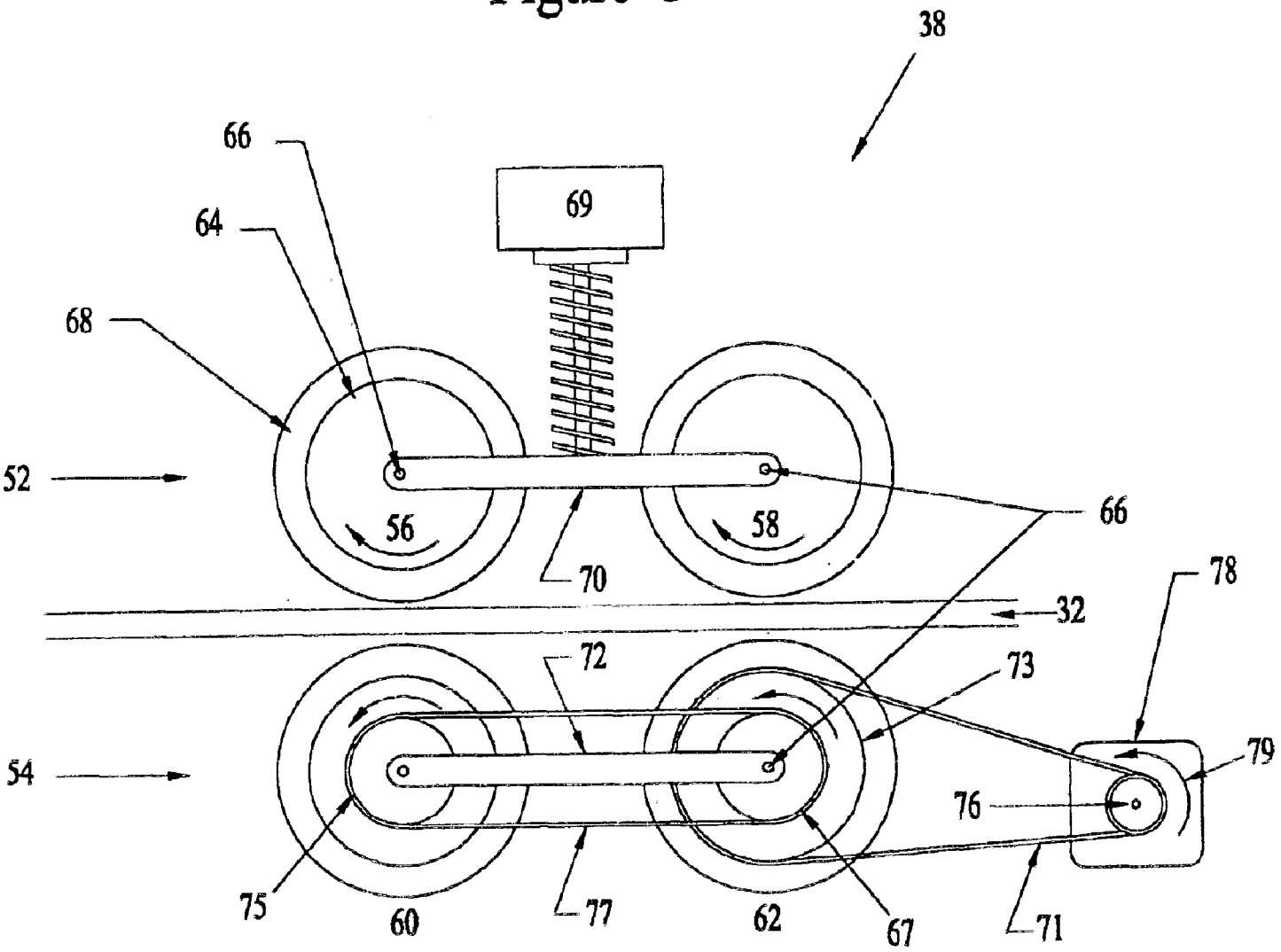
FIG. 3 is a side view of means for drawing material from the source of material in one embodiment of the invention.

Referring to FIG. 3 one embodiment of the motivating device (38) is shown. The device comprises two pairs (52 and 54) of two tandem mounted rollers. The first pair (52) comprises rollers (56 and 58) and the second pair (54) comprises rollers (60 and 62). The pairs (52 and 54) are positioned opposite to each other in a cooperating relationship. As exemplified by roller (56) each roller comprises a hub (64) mounted on an axle (66). A resilient elastomeric ring (68) is mounted on each hub (64) to provide frictional engagement between the roller (56) and the material (32). At least one pair of rollers (52) is connected to an adjustable compression device (69) that allows the force exerted between the roller pairs on material (32) to be adjusted to suit the type of material being used to construct the reinforcing members. For example, if the material being used is relatively lightweight fibreglass then the rollers will be adjusted to exert only a small compressive force so as not to damage the corrugated profile of the material. If the material is steel strand then the rollers are adjusted to exert a greater compressive force against the material so that there is no slippage of material. The rollers can also be completely disengaged, for example, when the crimping device is engaged, as previously noted.

Connecting arms (70 and 72) are connected between the axles of each pair to maintain each wheel of each pair in alignment. At least one of connecting arms (70) is operatively connected to biasing means (69) to move the set of rollers (52) towards or away from the opposite pair (54). Biasing means (69) may be a shuttle comprising a hydraulic cylinder, a motorized worm gear or a rack and pinion system. The biasing means may be remotely operable by an operator. The arms (70 and 72) also operate to ensure that the compressive load induced in the roller sets by the device (69) is equally distributed on the material during its passage between the rollers to avoid unwanted distortions in the material. At least one roller (62) is attached to a motor (78) to impart rotation (79) to the roller. The motor is usually hydraulic but may be electric depending upon the required application of the system. The roller (62) may be attached to the motor (78) by a drive belt (71) and pulley (73) arrangement. Alternatively, the drive may be a chain drive (71) connected to sprocket gear (63). Alternatively, the axle (66) may be coupled directly to the rotating shaft (76) of the motor. As shown in FIG. 3, rollers (62) and (60) may be driven in tandem by drive belt or chain (77) running between pullies or sprockets (75) and (67).

Figure 4:
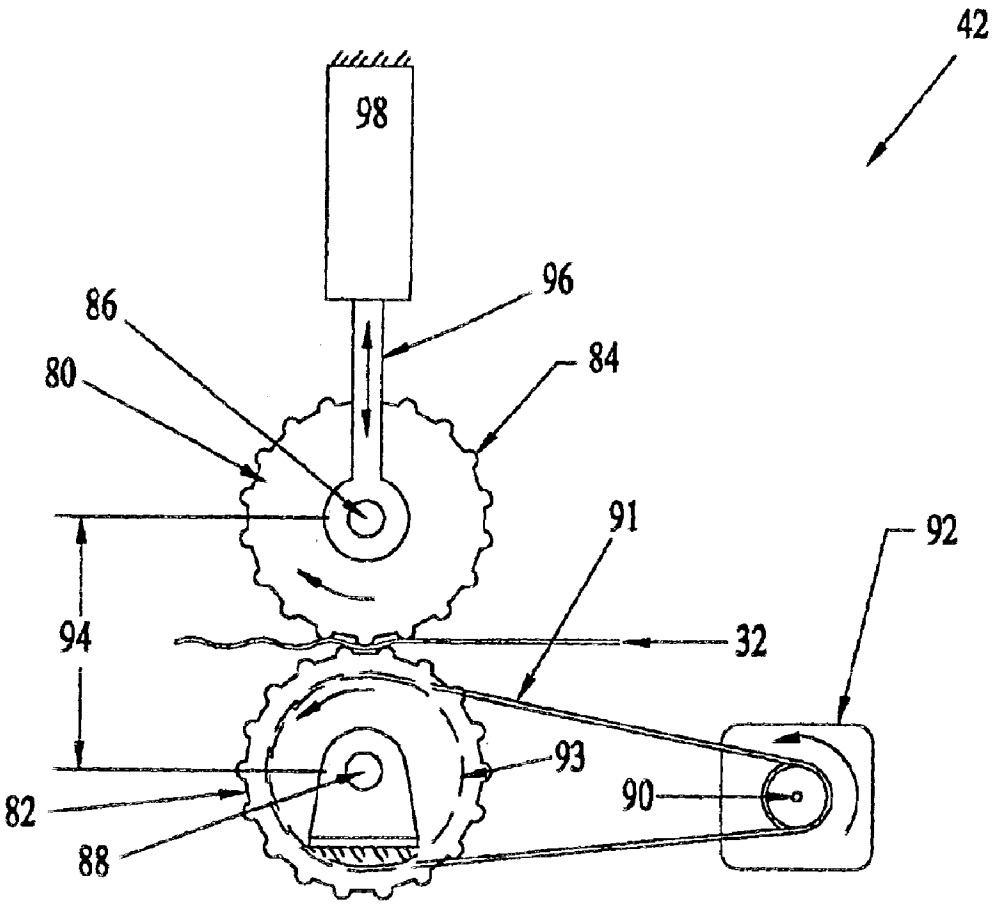
FIG. 4 is a side view of a crimping device of one embodiment of the invention.

Referring to FIG. 4 there is shown a crimping device (42) used in one embodiment of the present invention to shape metallic reinforcing material such as steel strand into desired corrugated shapes. The shaping device comprises a set of counter-rotating gear wheels (80 and 82). The wheels have a series of cogs (84) radially spaced around the circumference of each wheel. The cogs (84) are generally convex in shape. The cogs of one wheel intermesh with the cogs of the other wheel thereby providing the compressive forces necessary to shape the material (32) into the desired corrugated shape. Each gear wheel is mounted on its respective axle (86 and 88). At least one of the gears (82) is operatively coupled to a motor (92). The motor may be electric or hydraulic. The gear (82) may be coupled to the motor by way of a chain drive (91) and sprocket (93) arrangement. Alternatively, axle (88) may be directly coupled to the rotating shaft (90) of the motor (92). Gear wheel (80) is driven by gear wheel (82) in synchronous counter rotation through a system of connecting gears (not shown) that are adapted to adjust to the to and fro movement of member (96). The compressive force exerted by the cogs (84) on the material (32) is adjustable by varying the distance (94) between axle (86) and axle (88). At least one member (96) is operatively connected to at least one of the axles (86) at one end of the member and to shuttle device (98) at the other end. Shuttle device (98) imparts a controllable and adjustable to and fro motion to the member (96) that in turn varies the distance (94) and the amount of compressive force exerted by the cogs (84) on the material (32). For example, if a severe pitch is desired in a steel-reinforcing member then the intermeshing cogs will be placed in close proximity to each other to exert higher compressive forces on the steel. If a mild pitch is desired the gears will be opened up by increasing distance (94) thereby separating the cogs. The gear wheels may be spaced sufficiently apart so that the cogs are totally disengaged. This is desirable when materials such as plastic or fibreglass are being used as reinforcing material. Such material will be supplied with the desired profile negating the need for the shaping device. The shuttle device (98) may be a hydraulic cylinder and member (96) may be a hydraulic piston. The shuttle device (98) may also be a rack and pinion system or a worm gear system. Crimping device (42) will act in cooperation with motivating device (38) so that when it is necessary to move a length of reinforcing material into hole (14) the crimping device will be disengaged to permit unmolested movement of the material. Similarly, when the crimping device is engaged, the motivating device will be disengaged. The invention includes suitable control logic between the crimping device and the motivating device to coordinate their activities.

Referring back to FIG. 2, operator (20) will have control over the operation of the shaping device (42) by way of control panel (22). The operator can adjust the compressive forces exerted by the cogs on the material as well as completely disengage the gears if desired. In an alternative embodiment of the invention, the measuring device (40) is logically connected to shaping device (42) so that the length of material (32) to receive a corrugated shape may be automatically controlled. The operator may also pre-program the coordinated activities of the crimping device and motivating device by way of programmable controllers. This is particularly useful when there is a plurality of identical reinforcing members to be manufactured.

Figure 5:
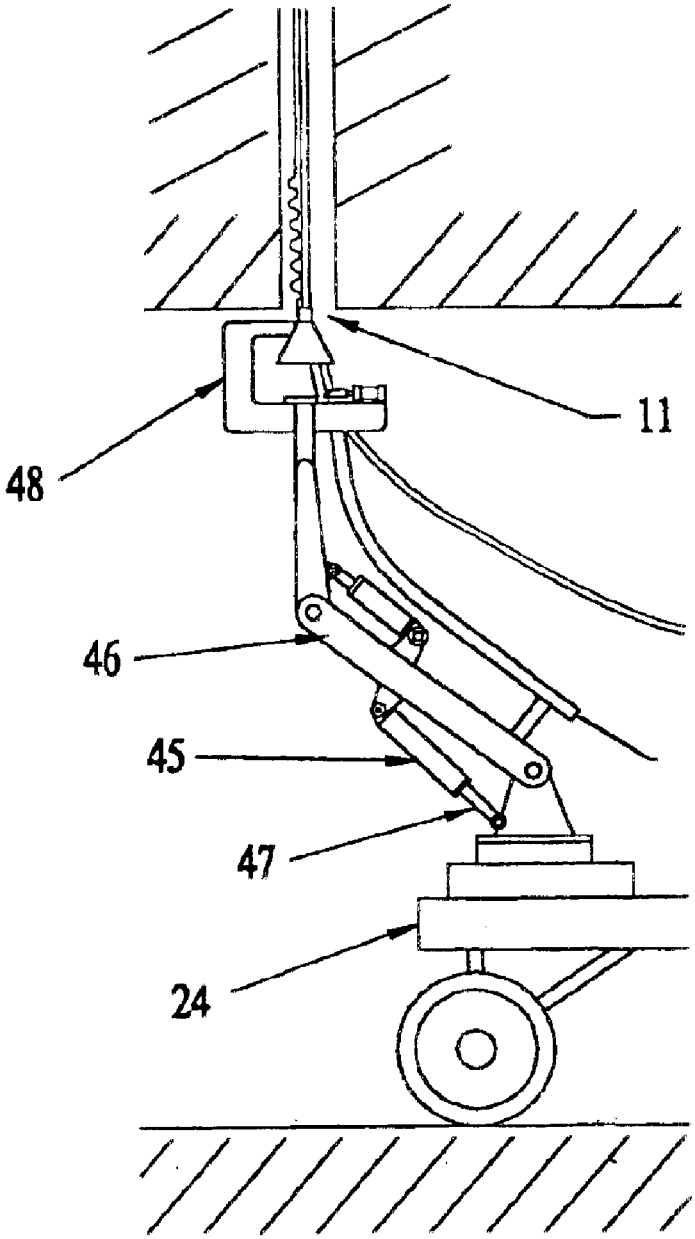
FIG. 5 is a side view of the articulating arm and guide head of one embodiment of the invention.

Referring to FIG. 5 there is shown an enlarged view of the front portion of the platform (24) of one embodiment of the invention. An articulating arm (46) is pivotally attached to the platform (24). The arm is shown attached to the front portion of the platform and actuated by hydraulic cylinders (45) and pistons (47). However, the arm may be placed in any convenient and operable location on the platform. The arm is free to move up and down and sideways in order to position a guide head (48) in proximity to the mouth (11) of the drill hole. The arm has an operating position in which the arm is at least partially extended as shown in FIG. (5). The arm also has a non-operating position where the arm is folded so that its articulating elements are stored parallel to the deck of the platform facilitating easy movement of the platform in a tunnel or into and out of an elevating device such as a mine cage.

Figure 6:
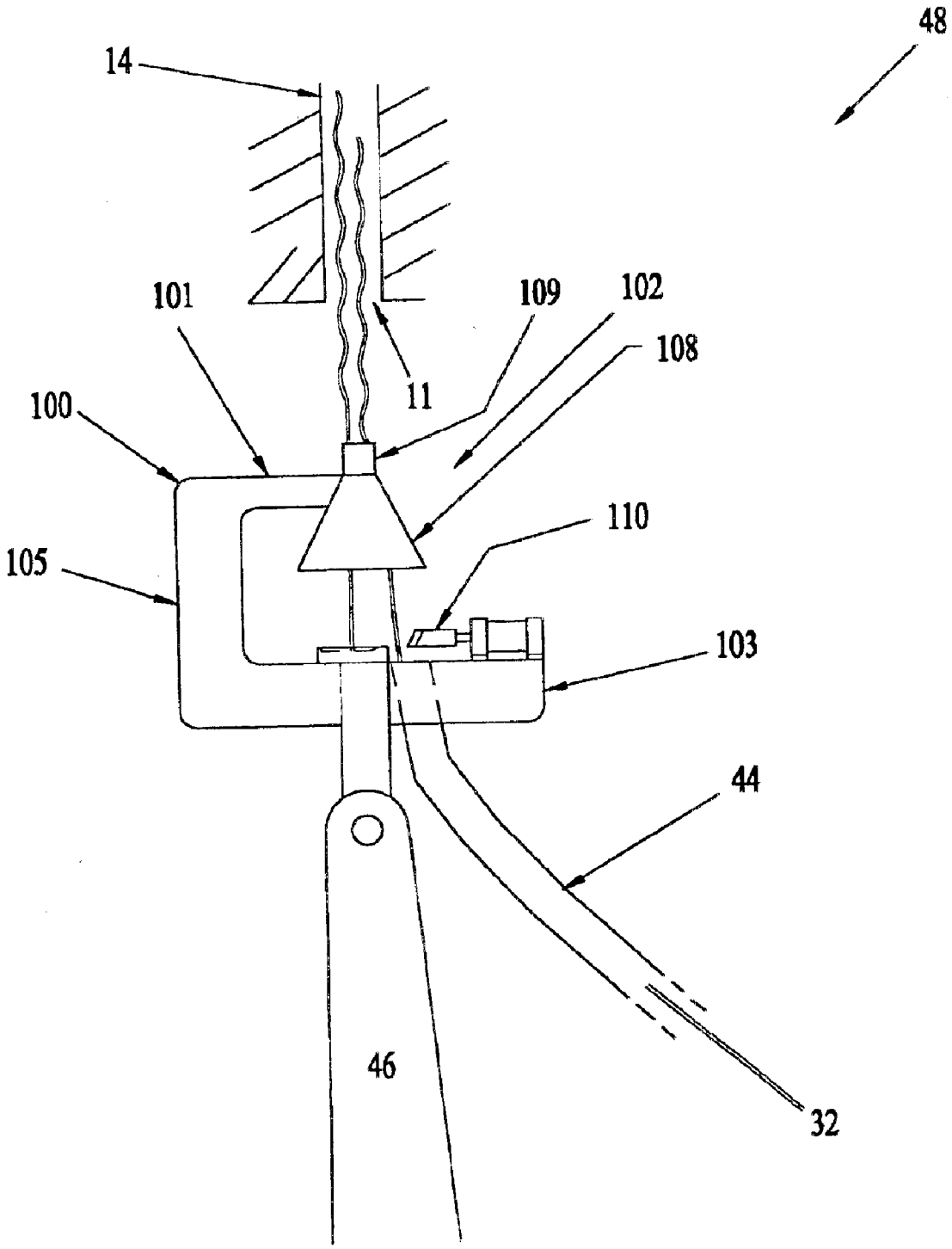
FIG. 6 is an enlarged side view of the guide head mounted to the arm of one embodiment of the invention.

Referring to FIG. 6, guide head (48) is mounted to the free end of arm (46). The guide head (48) comprises a "C"-shaped frame (100) and a guide funnel (102) fixed to the top leg (101) of the frame. Guide tube (44) is attached to the lower leg (103) of the frame (100) and penetrates the lower leg of the frame emerging in front of cutter (110) so that material (32) can be guided into the guide funnel (102). Upright leg (105) of frame (100) separates the upper from the lower legs of the frame. The guide funnel further comprises an inverted funnel-like guide body (108) and a guide spout (109). Guide body (108) receives the material (32) from the guide tube (44) and directs it into guide spout (109), which is placed adjacent to the mouth of the drill hole (11) and subsequently guides the material into the drill hole (14).

Figure 7:
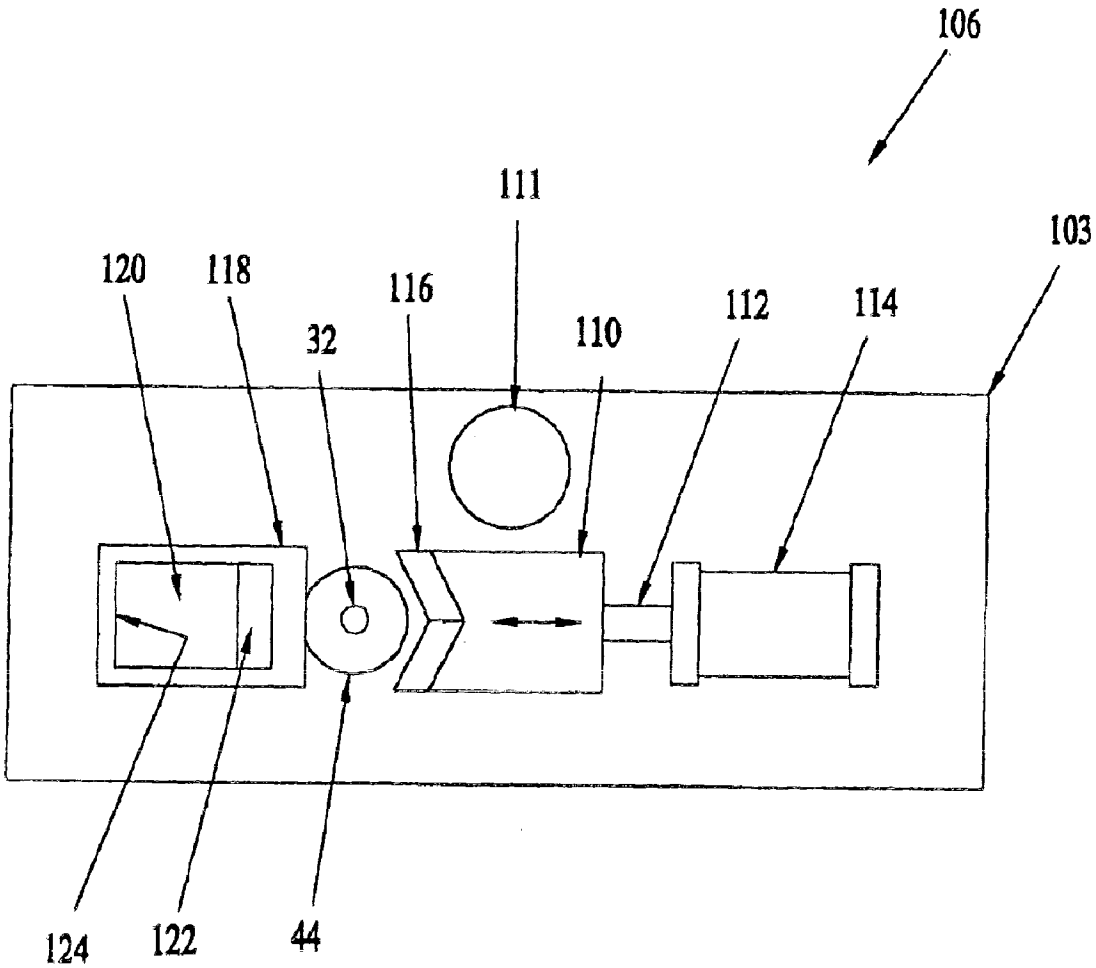
FIG. 7 is a top view of the cutting device of one embodiment of the invention.

Referring to FIG. 7, a top view of the cutting device (106) is shown and the operation of the device is explained by also referring to FIG. 6. Cutting device (106) is mounted to the lower leg (103) of frame (48). The cutting device (106) comprises a cutter (110) for cutting the material (32) into desired strand lengths. Material (32) is shown emerging from guide tube (44) just in front of the blade (116). The cutter is attached to a piston (112) that in turn is attached to a shuttle device (114) that imparts a controlled to and fro motion to the cutter. The shuttle (114) may be an electrical solenoid or a hydraulic cylinder. The blade (116) of the cutter has a bevelled chevron shape. This shape provides stability to the material (32) while it is being cut. The material is cut using shear forces generated by compressing the material (32) between the cutting blade (116) and the cutting block (118). Cutting block (118) has a rectangular hollow (120) having an inclined front wall (122) and a vertical back wall (124). The hollow holds the strands in a stacking arrangement after they are cut. Grouting tube hole (111) is also shown penetrating lower leg (103).

Figure 8:
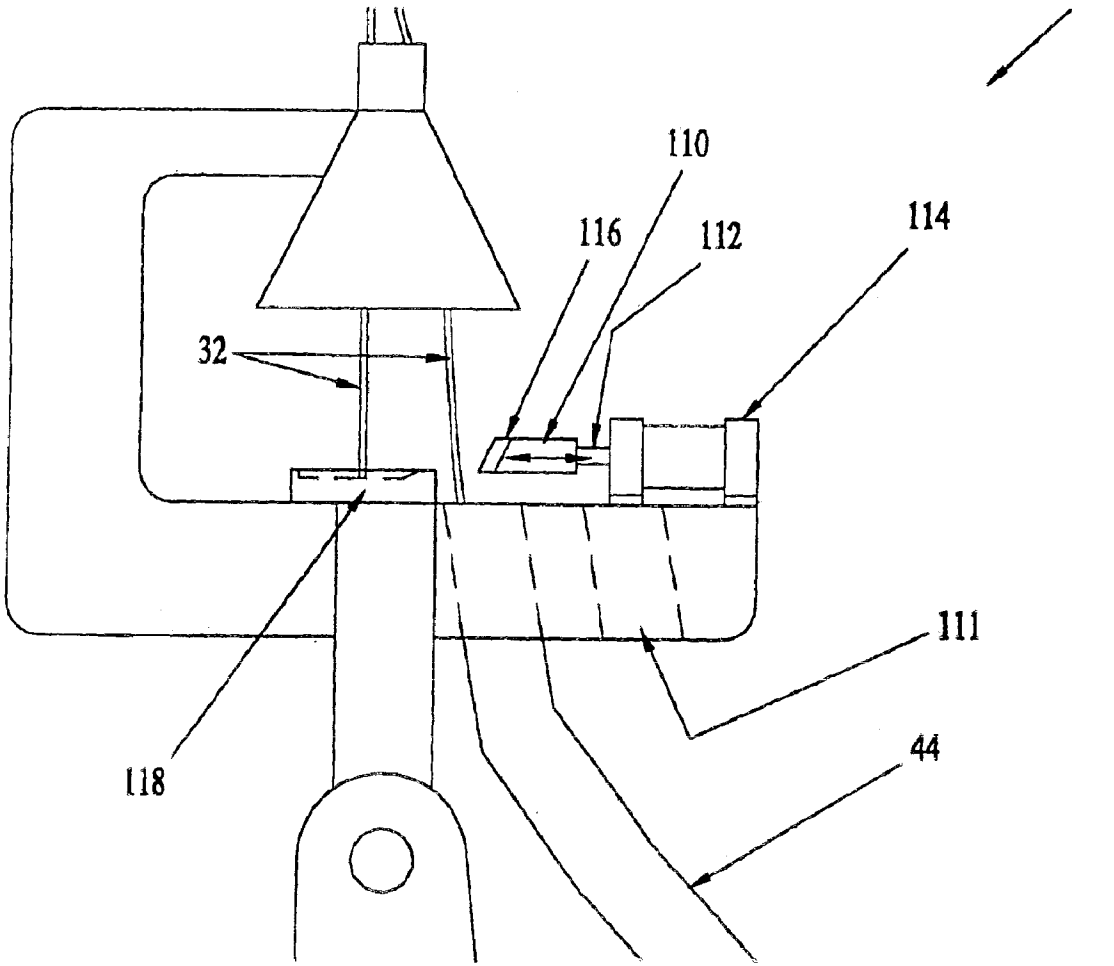
FIG. 8 is a side view of the cutting device in its first operating position.

FIG. 8 shows the cutting device (106) in side view. The cutter (110) has three operating positions. The first position indicated in FIG. 8 is its disengaged position. The material (32) emerges from the guide tube (44) and is generally centred between the blade (116) and the block (118). To move the blade (116) to the cutting position, shuttle (114) is engaged by the operator (20) to move piston (112) forward to the position indicated in FIG. 9.

Figure 9:
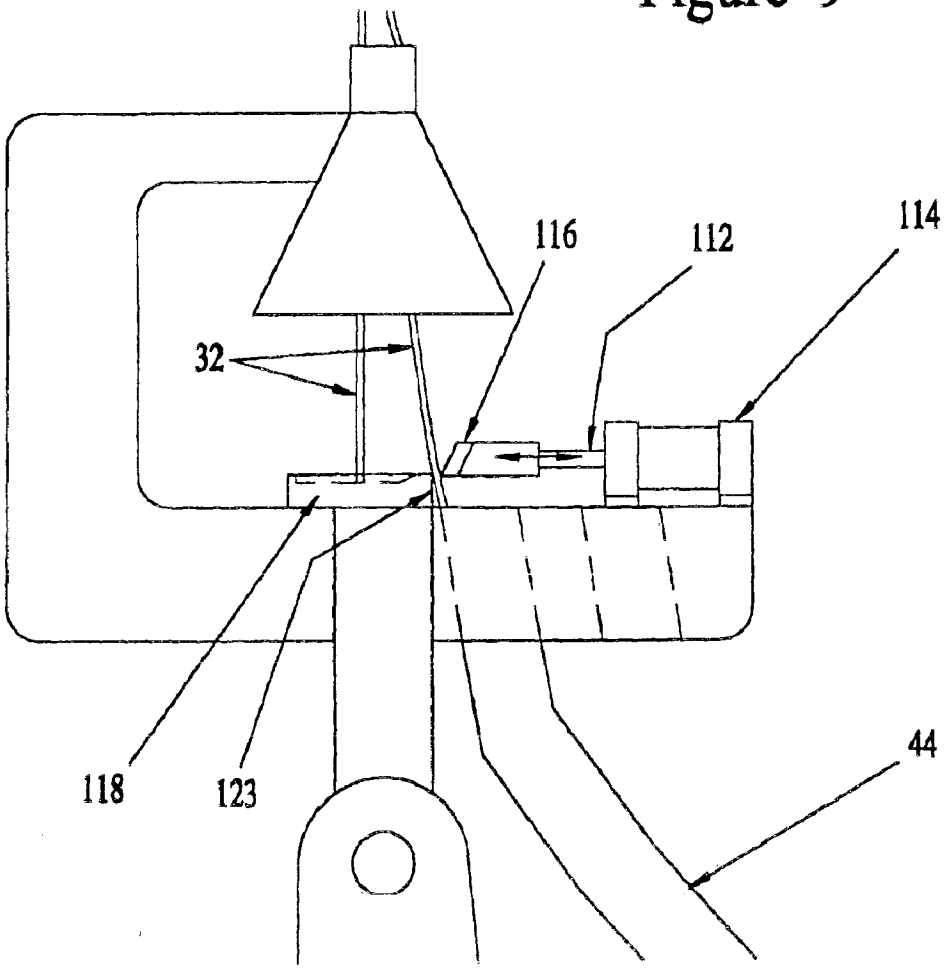
FIG. 9 is a side view of the cutting device in its second operating position.

Referring to FIG. 9, the blade (116) forces the material (32) to abut against the vertical face (123) of block (118) creating shear forces within the material. The shuttle (114) continues to push the blade (116) forward until the material is sheared and a strand of desired length is formed.

Figure 10:
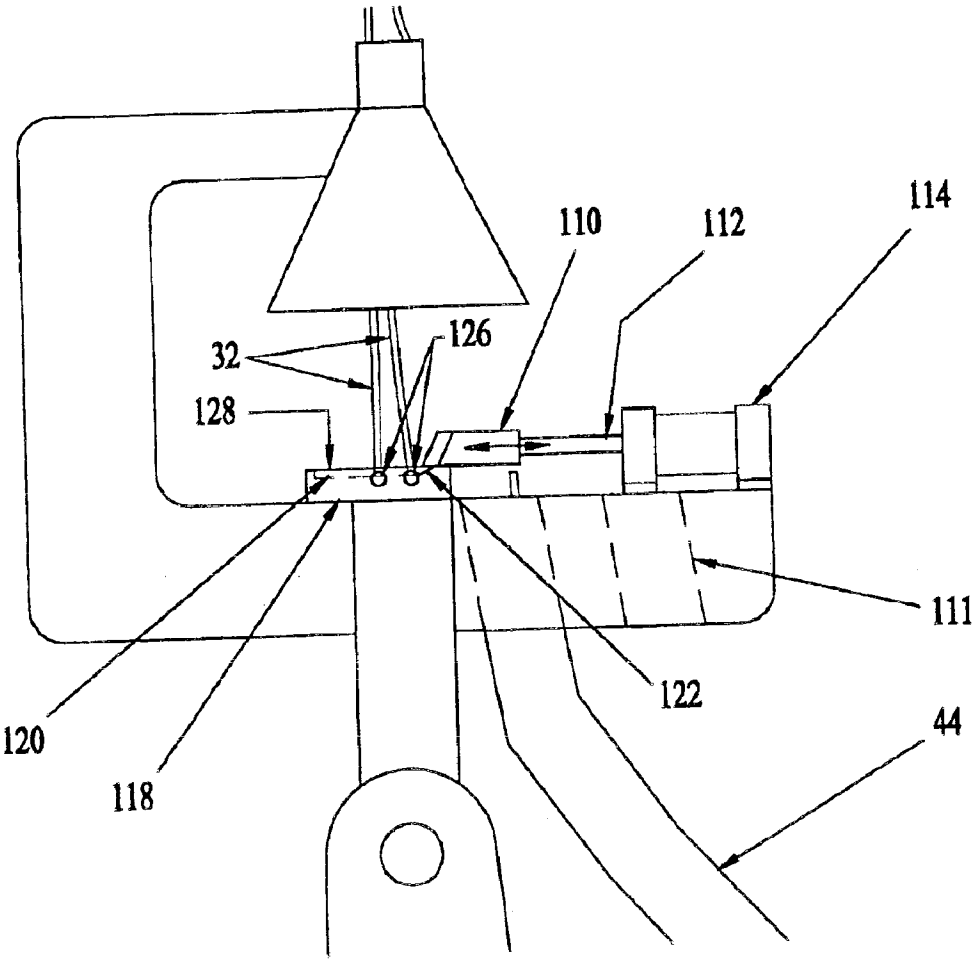
FIG. 10 is a side view of the cutting device in its third operating position.

Referring to FIG. 10, the shuttle (114) continues to force the cutter (110) forward so that the sheared end (126) of the material (32) is pushed along the upper surface (128) of block (118), down incline (122) and into hollow (120). This is the third position. A plurality of strands can be created and stacked in the hollow until the drill hole is ready for grouting. Once the strand is placed in the hollow the cutter is retracted by the shuttle to its disengaged position. Another strand of material is then advanced into the drill hole. The cutter may be logically connected to the measuring device (40) so that the operator can program the cutter to cut specific lengths of strand as required. FIG. 10 also shows the location of the grouting tube hole (111) in the lower leg.

Figure 11:
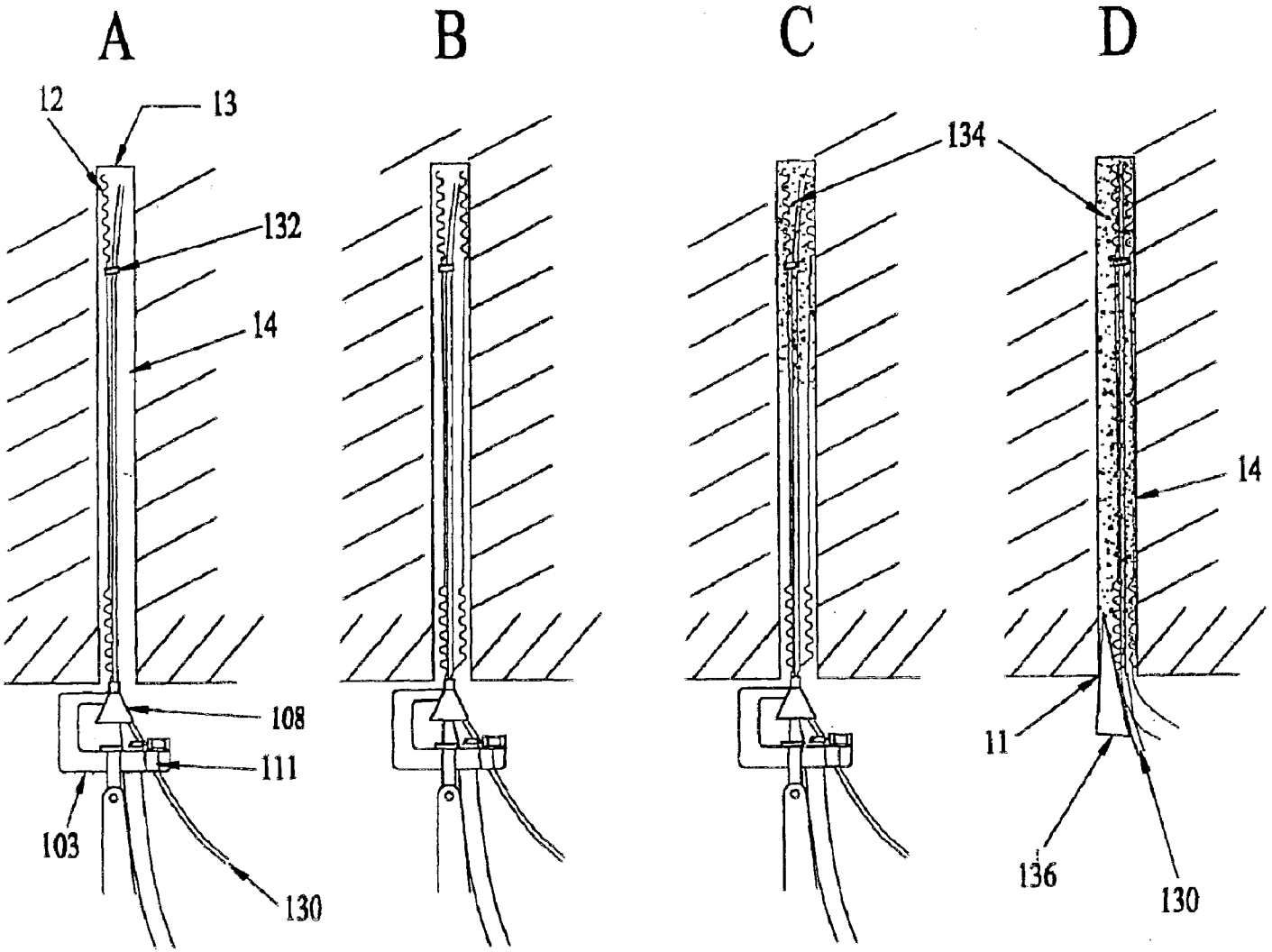
FIG. 11 is a cross-sectional view of a drill hole being grouted.

Referring to FIG. 11, the manner in which a cementacious grout is inserted into the drill hole using one embodiment of the invention is now explained. Referring to FIG. 11A, grouting tube (130) is fed through hole (111) in lower arm (103) and around the cutter (110) so that the cutter does not contact the tube. To accomplish this, as shown in FIG. 7, the hole (111) is offset from the cutter by a sufficient amount to avoid interference. Referring to FIG. 11A, the operator will have attached the grouting tube (130) by way of a band of tape (132) to the top of the first strand (12) before it is inserted into the drill hole (14). The grouting tube (130) is also directed through the guide funnel (108). Additional strands can then be inserted into the drill hole without interference from the grout tube. The end of the tube (130) is at the toe (13) of the hole (14). As shown in FIG. 11B additional strands are inserted into the hole as required by the operation. Referring to FIG. 11C, once the desired number of strands have been inserted into the hole, grout (134) can be pumped into the drill hole. Referring to FIG. 11D once the hole is filled with grout a wedge (136) is placed into the mouth (11) of the hole (14) to maintain the strands in place and the grout in the hole until it sets. The grouting tube (130) is severed at the collar of the drill hole and left in the hole.

Figure 12:
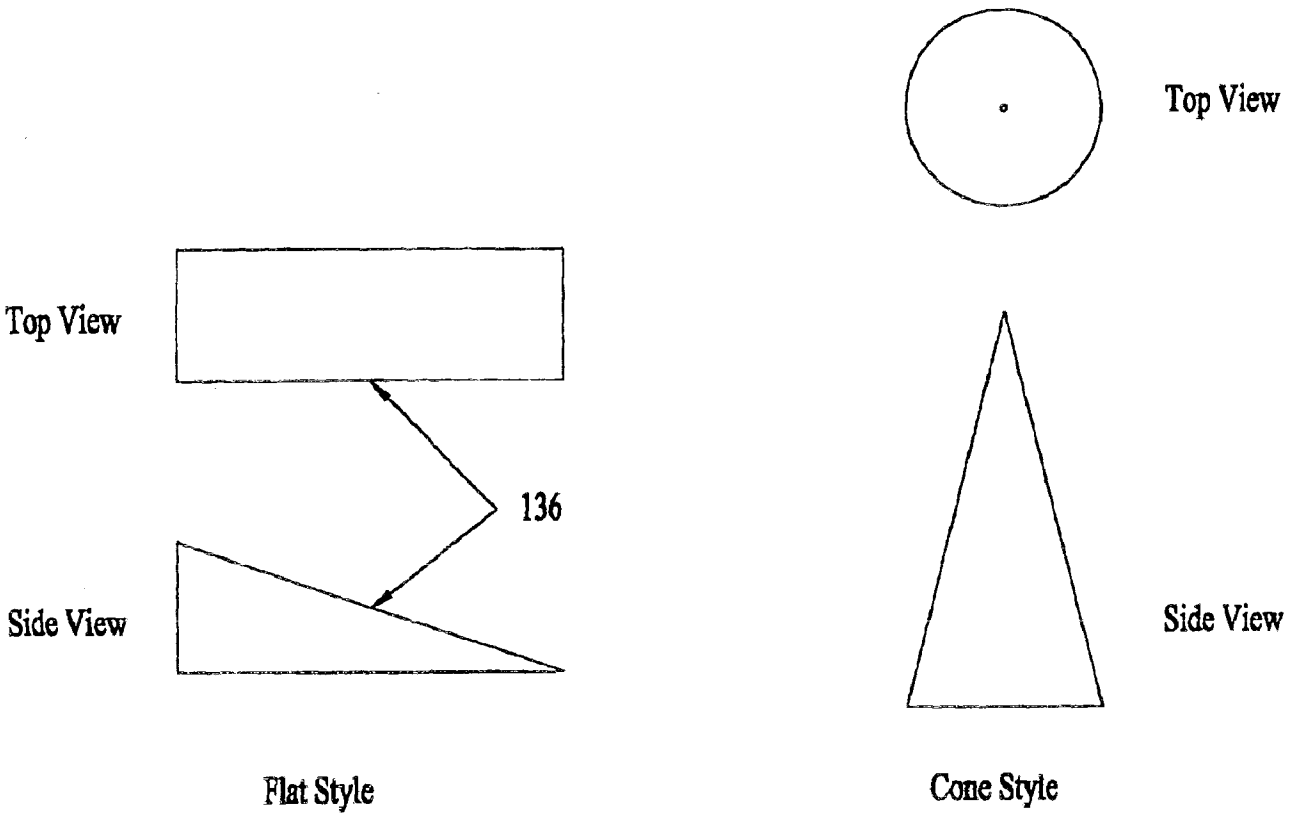
FIG. 12 shows two types of wedges embodied in the invention.

Referring to FIG. 12, the wedge (136) can take different shapes. Show in FIG. 12 is a flat style and a cone style wedge. The flat shaped wedge would be inserted between the reinforcing members and the side of the wall of the hole as shown in FIG. 11D. The cone shaped wedge would be inserted into the centre of the hole.

Figure 13:
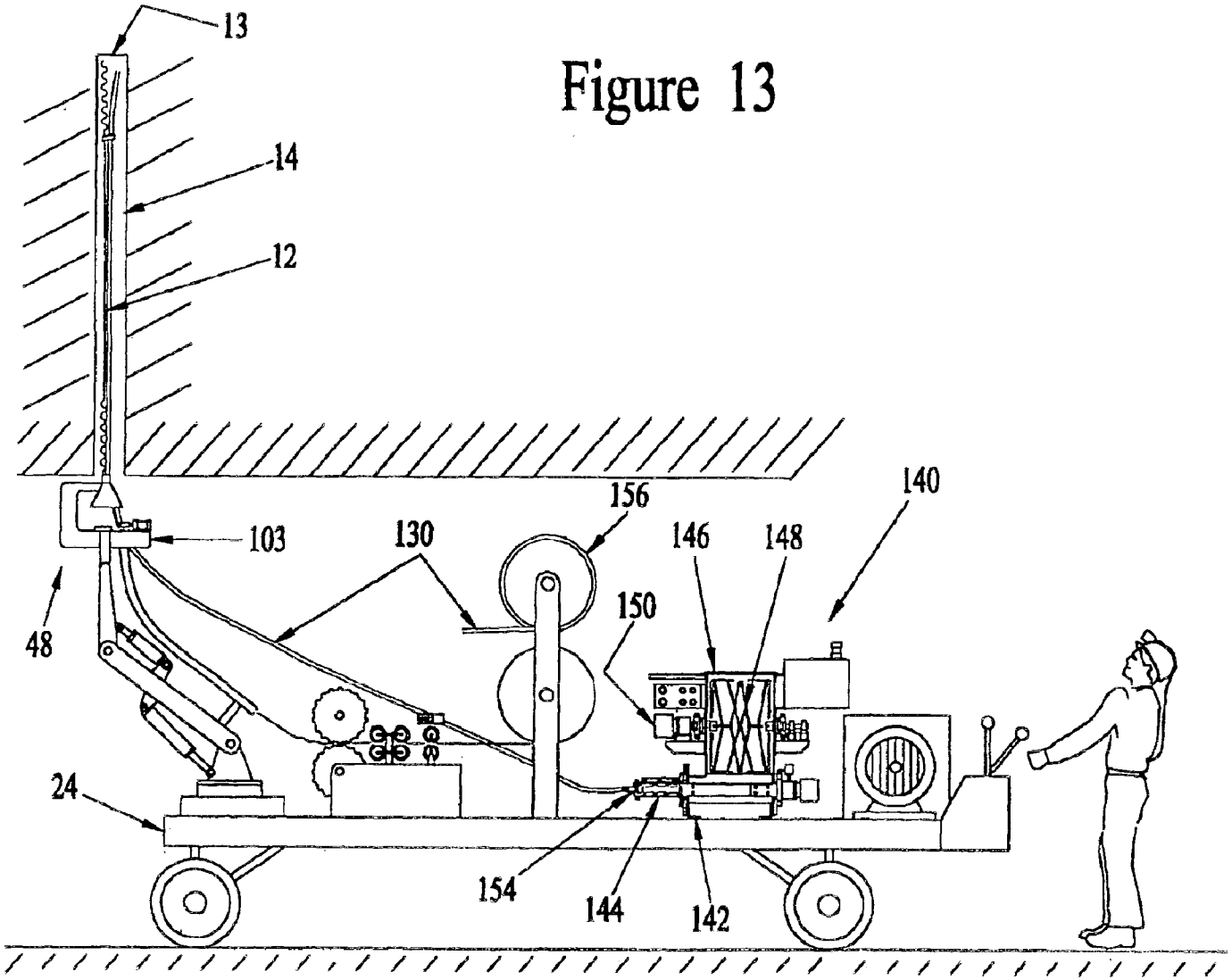
FIG. 13 shows a side view of one embodiment of the invention with the cement grouting pack mounted to the platform.
Figure 14:
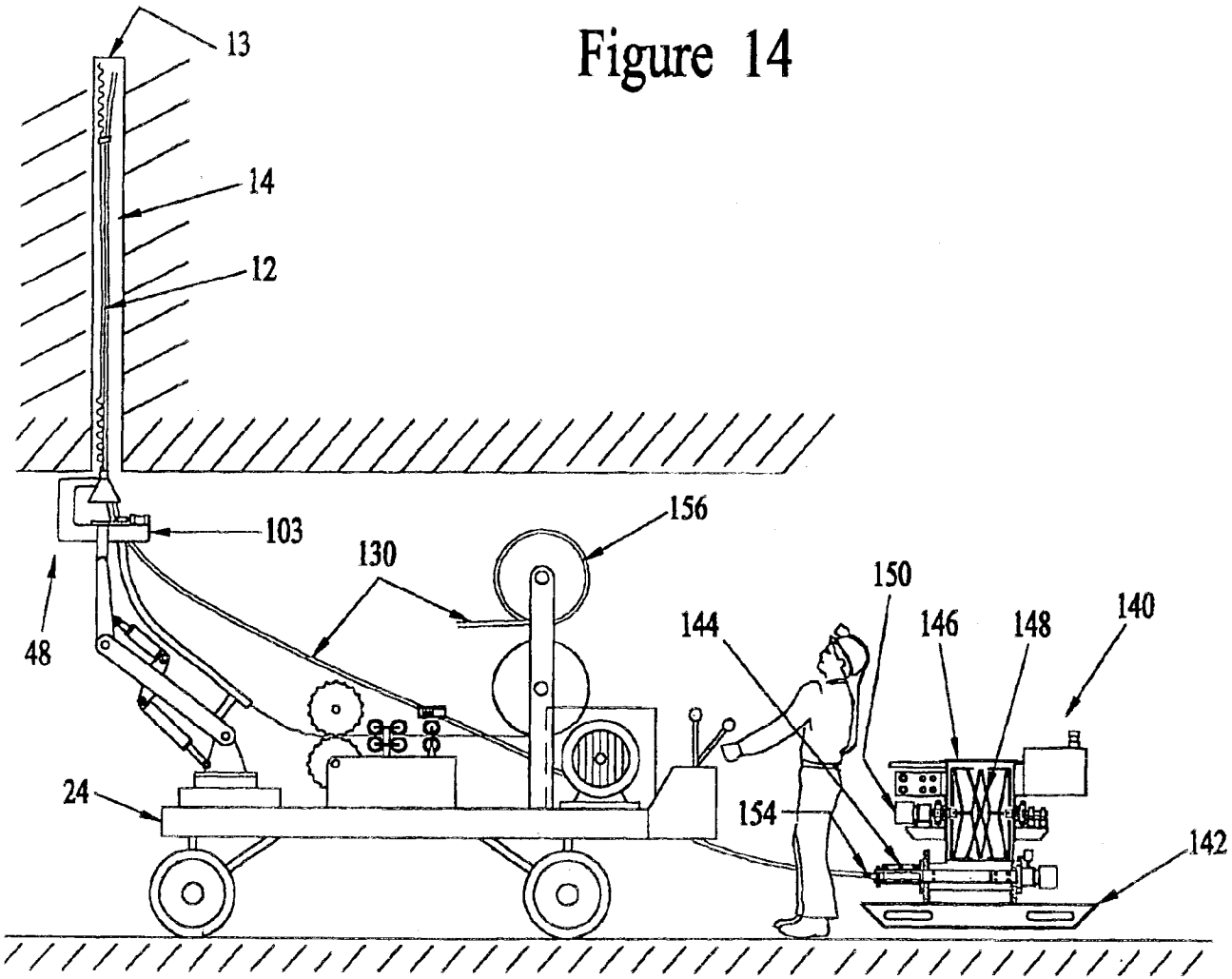
FIG. 14 is a side view of one embodiment of the invention with the cement grouting pack dismounted.

Referring to FIG. 13 the invention includes apparatus (140) that is used to grout the drill hole with cementacious grout after the reinforcing members have been installed in the hole. A dismountable cementacious grout mixing pack (140) is shown in its mounted position on the platform (24). FIG. 14 shows the grouting pack for cementacious grout in its dismounted position. The grouting pack can be lifted from the platform by a forklift truck or a small crane. Referring to FIGS. 13 and 14, the cementacious grouting pack comprises a base (142). Mounted to the base are displacement pump (154), hydraulic pump drive (144) and mixing chamber (146). The blades (148) in the mixing chamber may be powered by an electric motor or hydraulic motor (150). Tube (130) is connected to the discharge of the pump (154) and fed through the base of the guide head (48) lower frame (103) and hole (111). As noted above, the end of the tube is taped to the first strand inserted into the hole so that end of the tube is placed adjacent to the toe (13) of the drill hole (14). A supply of tube is stored on the platform on a dispenser (156). The tube can be any suitable tubing.

Figure 15:
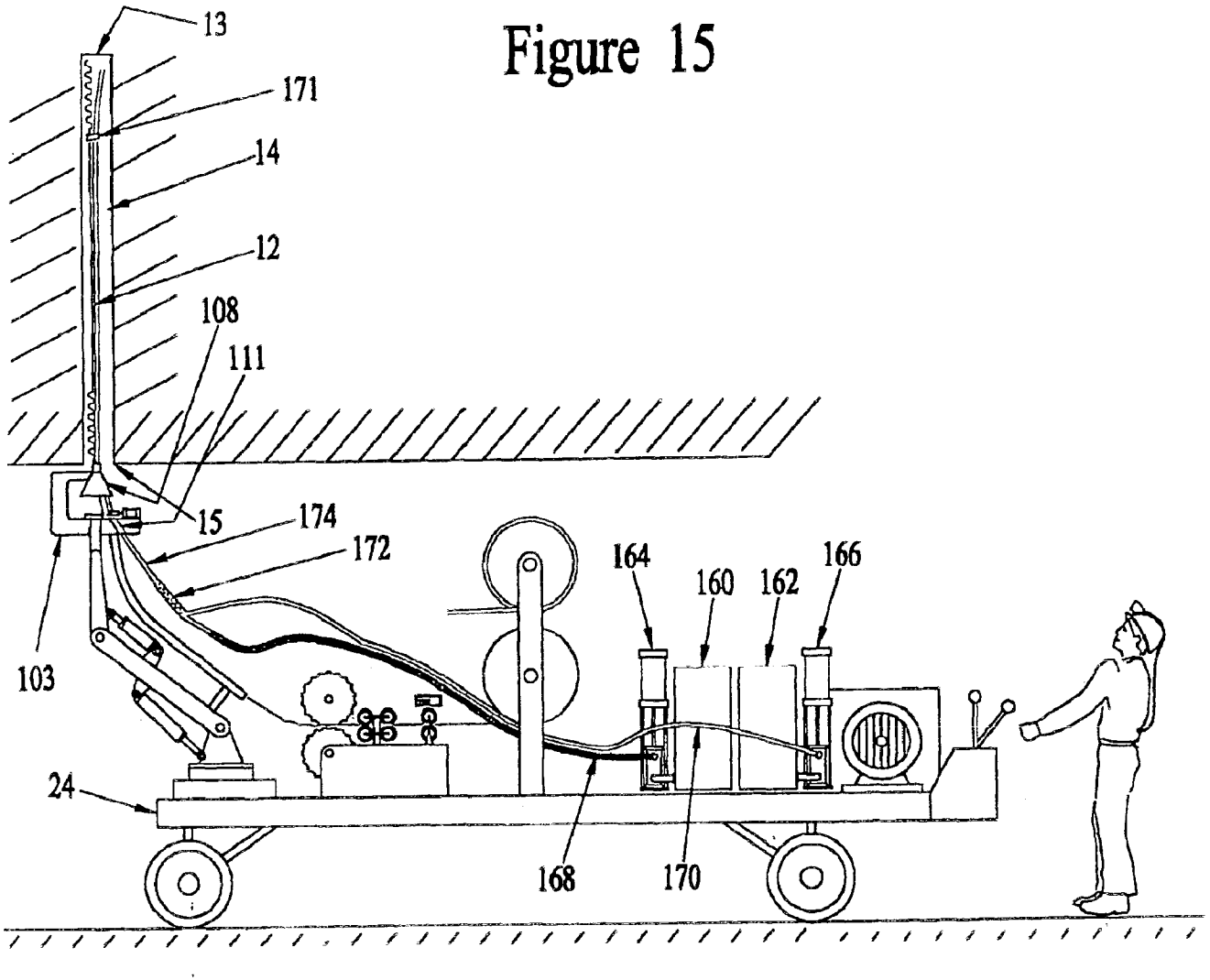
FIG. 15 is a side view of one embodiment of the invention with a binary resin grouting system mounted to the platform.

Referring to FIG. 15, the grouting material may comprise a polyester resin material. The resin originates in a binary form such that when the binary elements are combined the resin quickly cures. The binary elements of the polyester grout are stored in reservoirs (160) and (162) respectively. Pumps (164) and (166) are connected to each respective reservoir. Tubes (168) and (170) carry the binary elements of the resin to a static mixer (172) where the binary elements are combined. From the static mixer, a single tube (174) carries the mixed resin and extends through hole (111) in frame arm (103) through guide funnel (108) into the drill hole (14) to the toe of the hole (13). When using a binary resin grout the tube (174) will be attached to the end of the first strand (12) by a piece of tape (171). A desired amount of resin is pumped into the hole where it cures. The entire drill hole may be filled with resin. Alternatively, the open tip of the mixing tube can be relocated at a point closer to the collar of the drill hole in order to grout specific sections of the drill hole as operationally required such as the toe and collar.

Figure 16:
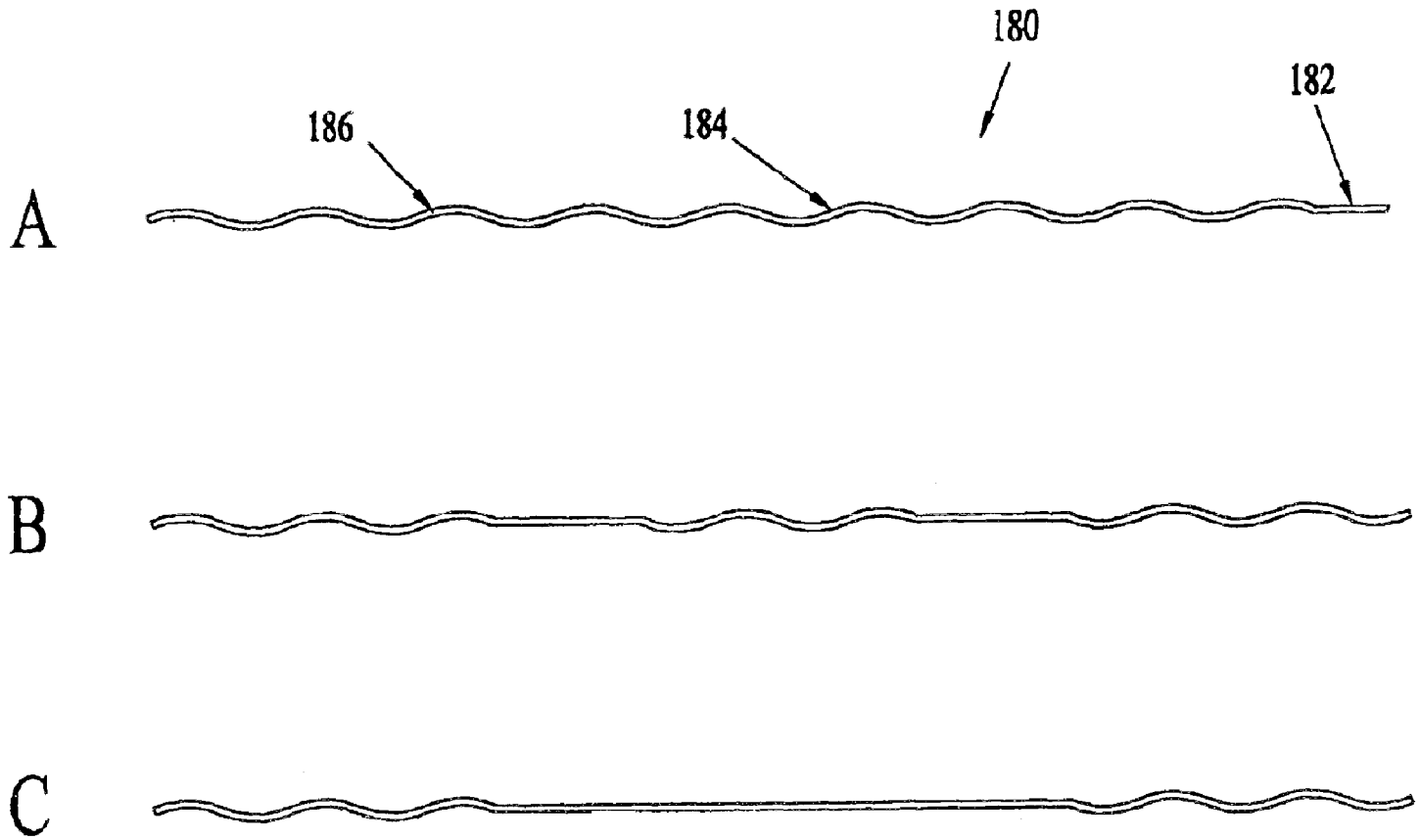
FIG. 16 illustrates a single strand reinforcing-member in one embodiment of the invention.

Another feature of the invention is the reinforcing member. Referring to FIG. 16A, one embodiment of the reinforcing member is shown. This embodiment is a single strand member manufactured and installed by the mobile system described above. The member (180) comprises a head part (182) that will extend from the collar of the drill hole and a body part (184) that will be placed in the drill hole. A person skilled in the art will know that the length of the member is to be determined by the depth of the drill hole which in turn is determined by the type of tunnelling operation, type of rock and the stability of rock that is to be reinforced. The member has corrugated portions (186). As shown in FIG. 16A the member may have its length entirely corrugated. Alternatively, as shown in FIGS. 16B and 16C it may be desirable to impart a corrugated shape only to portions of the member. The amount of corrugation imparted to a member determines, in part, the yield strength of the member. For a fully grouted drill hole, a larger number of corrugations generally provides a greater yield strength.

Figure 17:
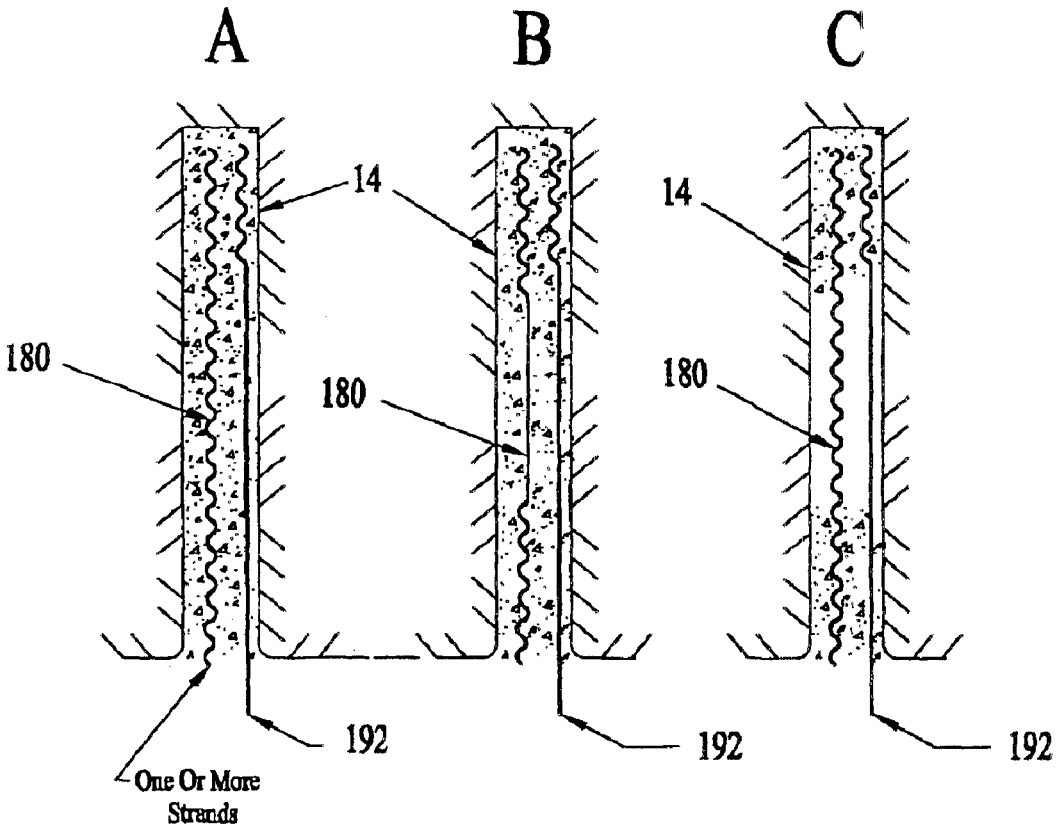
FIG. 17 illustrates the variable yield strength of a single strand reinforcing member of one embodiment of the invention.

For example, referring to FIG. 17, in construction applications, it may be necessary that there be no yielding between the reinforcing member and the rock in which it is placed. In such an application the member (180) be fully corrugated and the drill hole fully grouted. A plurality of members (180) may be placed in the drill hole (14). FIG. 17A shows the drill hole filled with grout. This configuration provides maximum strength with minimum relative displacement between the reinforcing member and the rock body. An extensometer (192) may be anchored in the grouted hole to detect any relative movement between the extensometer and the rock body. In other applications, it may be desirable to reinforce the rock in such a manner that there is a degree of yield and relative movement in the rock. This is most common in mining operations. Some yield is desirable to slowly release pressures that may build in a rock body during mining operations and to avoid a sudden reinforcing member failure without warning or "rock burst". To permit some yield, the reinforcing member may be corrugated at its ends with the entire hole grouted as shown in FIG. 17B. Alternatively, the member may be corrugated at its ends with toe and collar grouting only as shown in FIG. 17C. The resulting configurations shown in FIGS. 17B and 17C will be able to slowly yield in a perceptible manner over time. Extensometers (192) may also be anchored into the toe of the drill hole to provide an indication of relative movement. The ends of the extensometers extend out of the hole and can be visually or electronically monitoring to determine the amount of movement of the rock relative to the extensometer.

Figure 18:
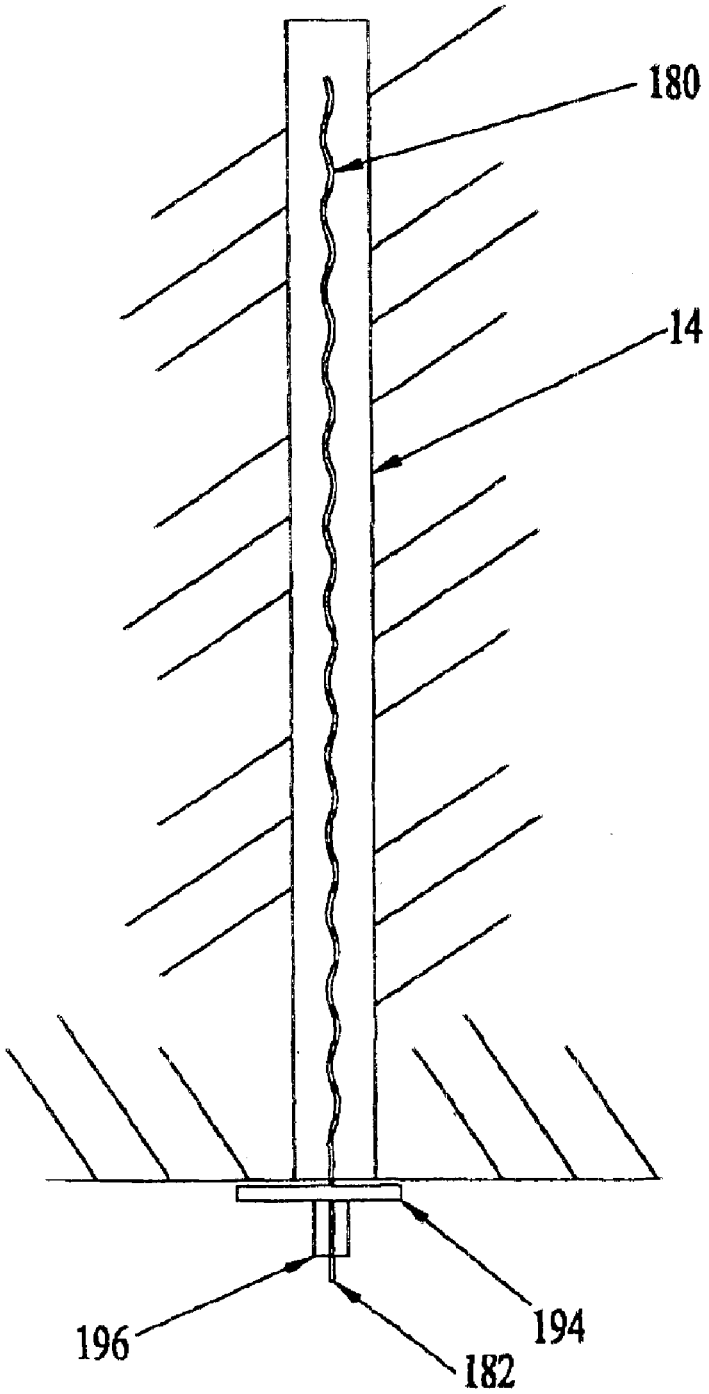
FIG. 18 illustrates in sectional view a single strand reinforcing member in a drill hole with anchor plate and stopper of one embodiment of the invention.

Another aspect of the invention is shown in FIG. 18. It may be necessary to secure an anchor plate on the head of a single strand or a plurality of strands. Prior to inserting the strand (180) into the drill hole (14) a metallic button (196) is inserted onto the end (182) of the member. The button is then compressed so that it is fixed to the end of the member. Anchor plate (194) is placed over the member (180) so that it abuts against the metallic button (196). The hole has been grouted and the member is inserted into the drill hole (14).

Figure 19:
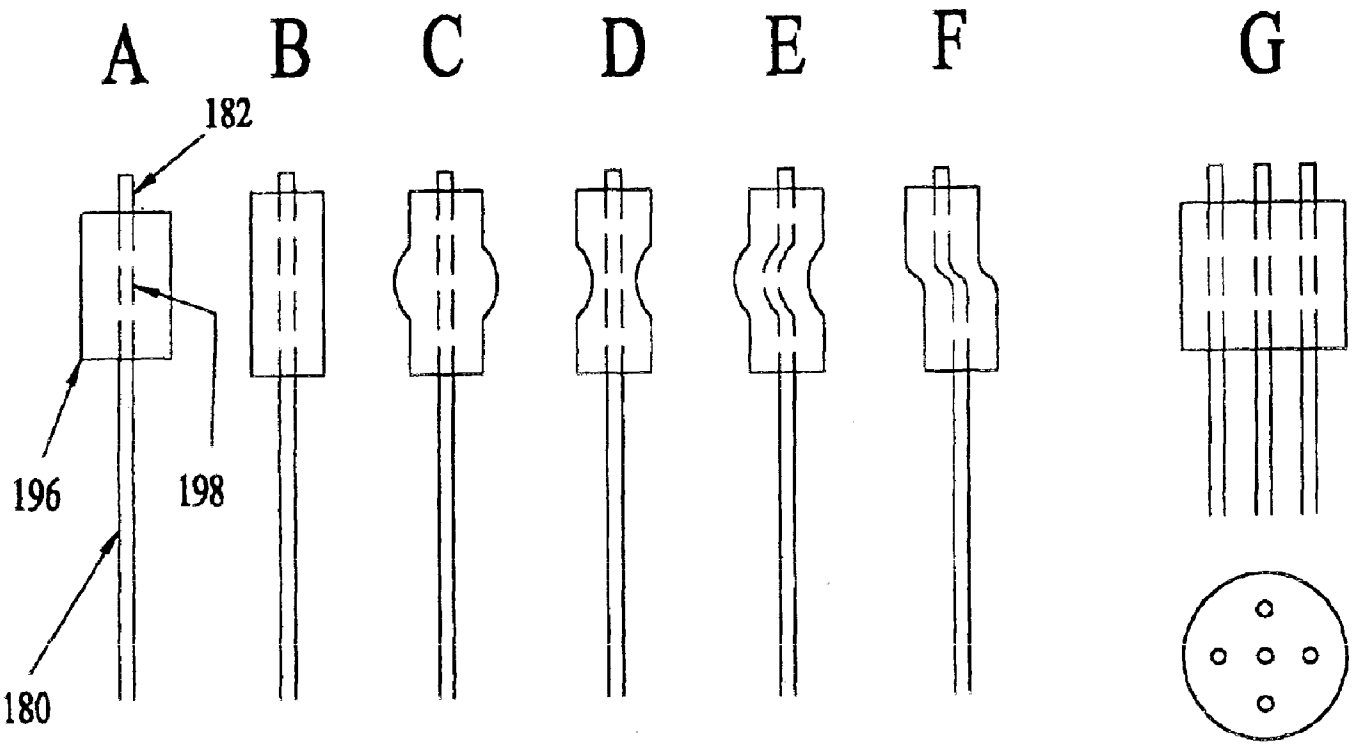
FIG. 19 illustrates in side view a variety of compressed configurations of the stopper embodied in the invention.

Another aspect of the invention is shown in FIG. 19. Referring to FIG. 19A, the button (196) is shown mounted on the end (182) of the strand (180). The button is a generally rectangular body of compressible metal with a passage (198) adapted to fit over the head of the end (182). As shown in FIGS. 19B to 19F the button can be compressed in a variety of different shapes to fix the button to the end of the member. Such compression would be accomplished by a hydraulic press mounted onto the platform (24) with press moulds adapted to give the desired shape to the compressed button. As shown in FIG. 19G, the button can have a plurality of passages adapted to accept a plurality of strands.

Figure 20:
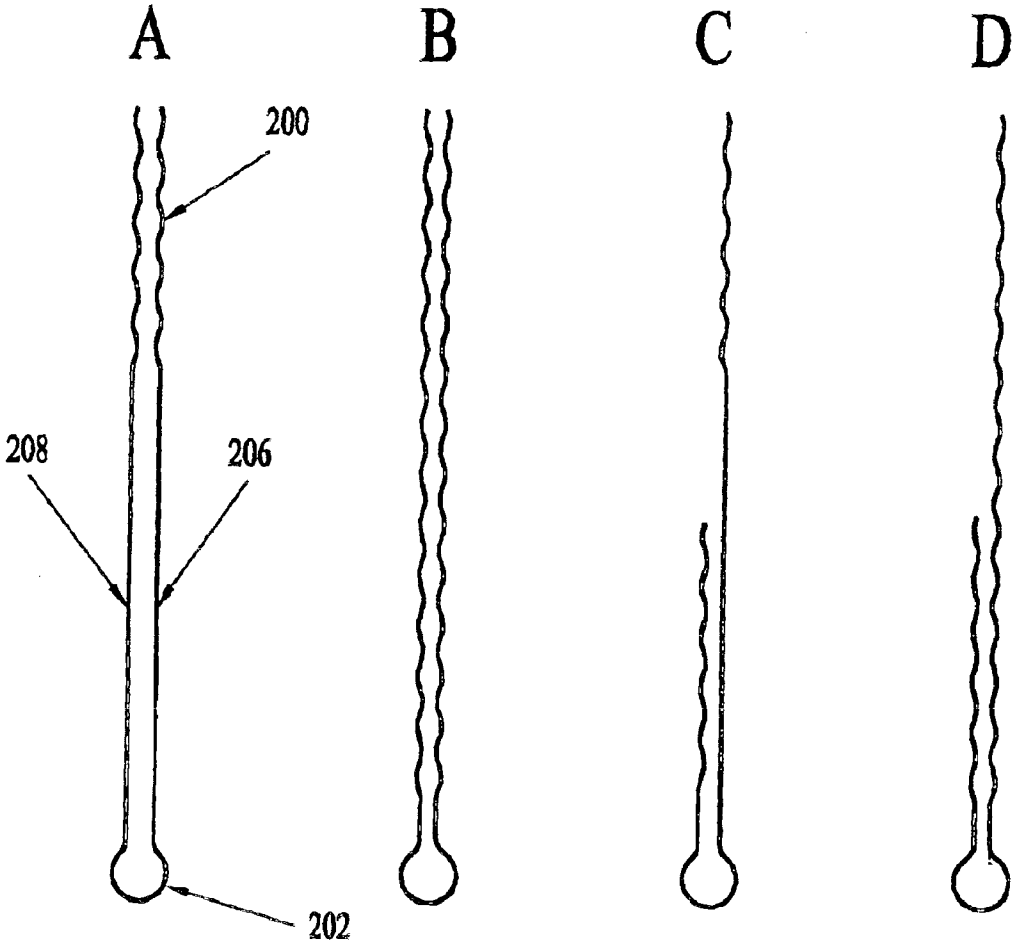
FIG. 20 illustrates another reinforcing member embodied in the invention.

Another aspect of the invention is shown in FIG. 20. Referring to FIG. 20A, there is shown a reinforcing member (200) comprising a head (202) and a pair of substantially parallel legs (206) and (208) depending from the head. As shown in FIG. 20B the legs may have a varied of corrugated profiles. As shown in FIGS. 20C and 20D the legs may be of varying lengths to suit the reinforcing application. In order to achieve the hairpin shape a bending device may be included on the platform (24).

Figure 21:
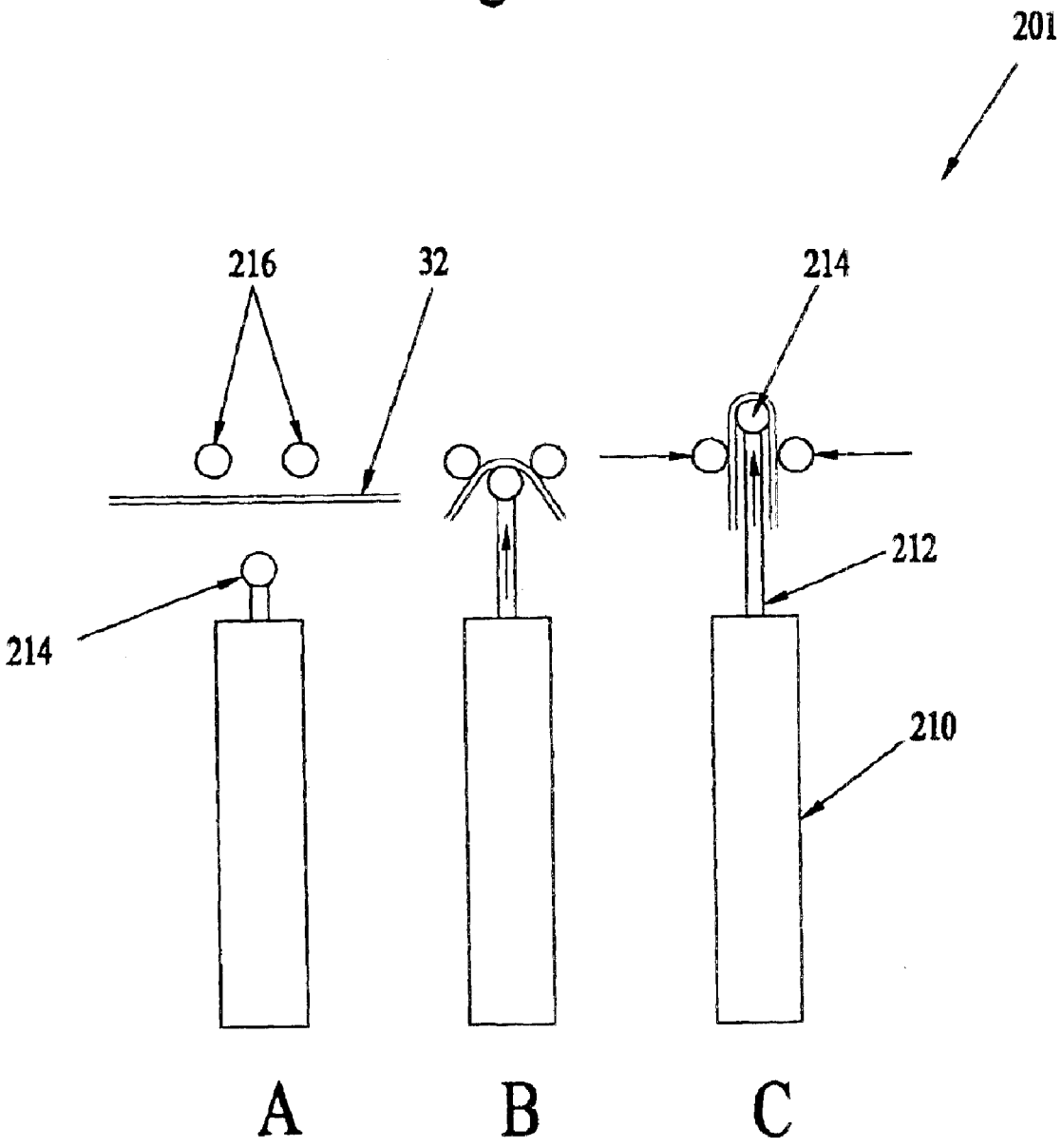
FIG. 21 shows the bending device of one embodiment of the invention.

Referring to FIG. 21 the bending device (201) comprises a hydraulic cylinder (210) operatively connected to a piston (212). The piston has a curved head (214). The head of the piston has a diameter equal to the desired diameter of the head of the member. A pair of spaced apart shoulders (216) is placed below the piston such that the head of the piston is interposed between the shoulders in its extended position. The spaced apart shoulders are generally fixed. However, they can be pressed inwards to provide a more circular shape to the head of the member. Referring to FIG. 21A, the reinforcing material (32) is placed between the shoulders (216) and the head (214) of the piston (212). Referring to FIG. 21B, the piston is extended is to press the strand between the shoulders forming the two parallel legs as shown in FIG. 21C. The shoulders in FIG. 21C may then pressed together to impart the required shape to the head of the member.

Figure 22:
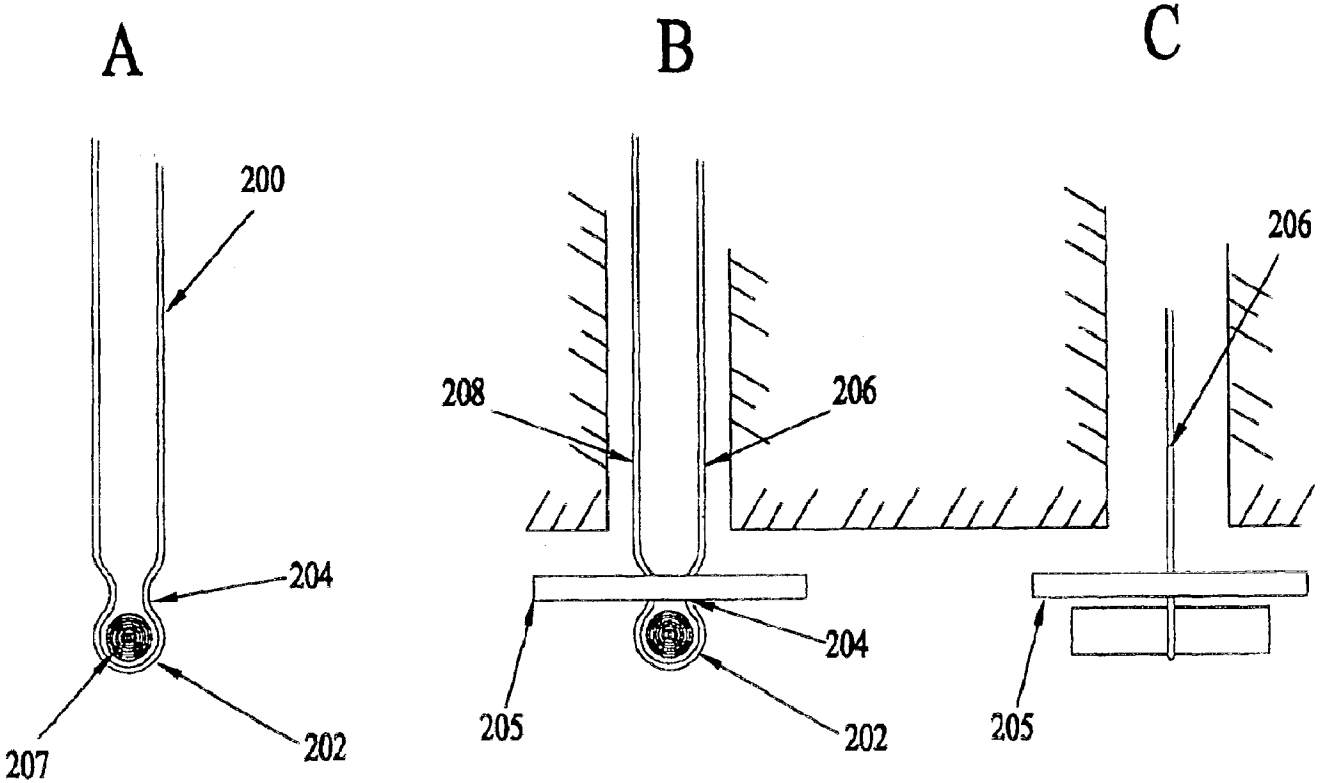
FIG. 22 illustrates in side view an anchor plate mounted to a reinforcing member of one embodiment of the invention.

Referring to FIG. 22, in some reinforcement applications it may be desirable to use the exposed ends of the reinforcing members to hang devices from the rock face. Such devices could include pipes, electrical wiring or reinforcing netting in the form of a lattice. In such applications it may be necessary to install an anchor plate over the reinforcing member and fix it in place. Referring to FIG. 22A reinforcing member (200) is shown having a head (202) and a crimped portion (204). Dowel (207) is illustrated placed in head (202) of the member. While dowel shown is sold, it may also be a section of hollow steel pipe. As shown in FIG. 22B, anchor plate (205) is pressed over the head (202) of the member and straddles the crimped portion (204) of the member. The crimped portion can be elastically compressed so that the anchor is partially retained in place by the biasing action of the legs (206 and 208) against the anchor plate until the dowel (207) can be inserted. As shown in FIG. 22C, the dowel is then inserted into the head of the member thereby retaining the anchor in an abutting relationship with the rock face.

Figure 23:
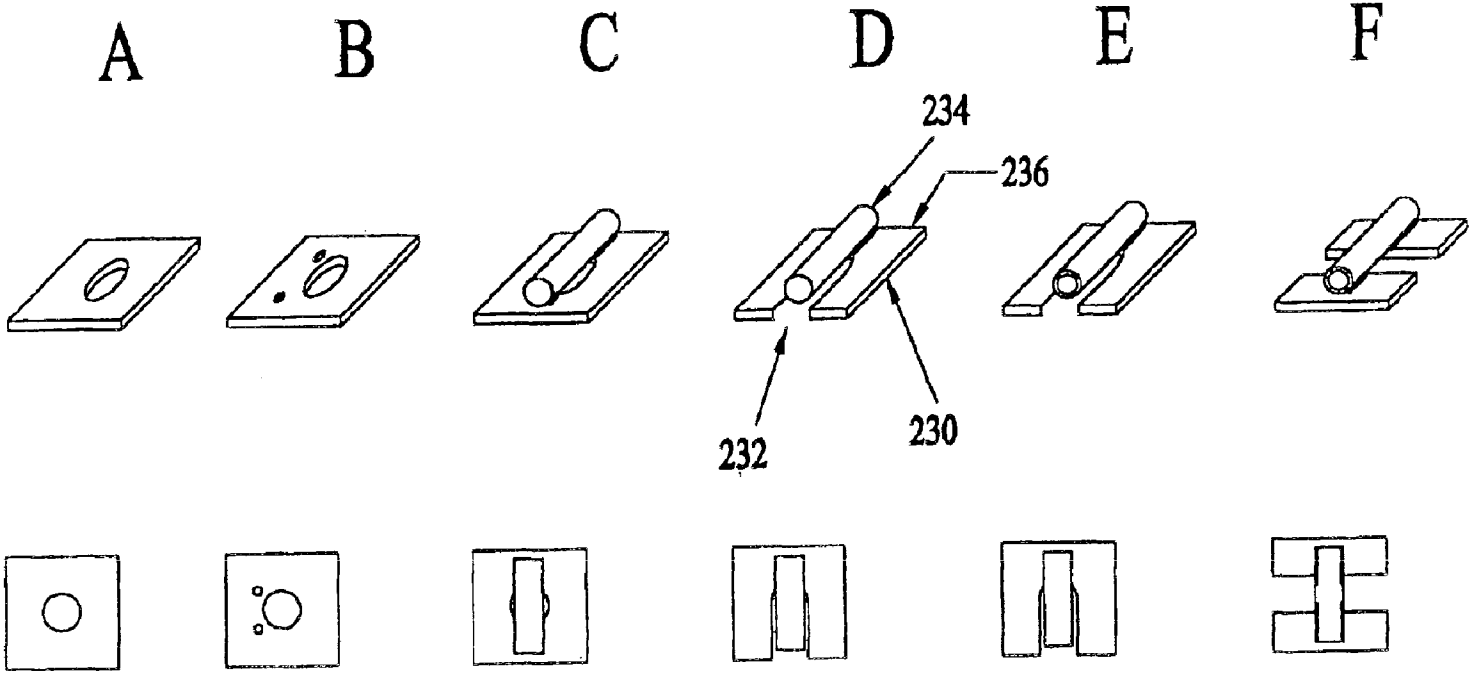
FIG. 23 shows various anchor plates embodied in the invention.
Figure 24:
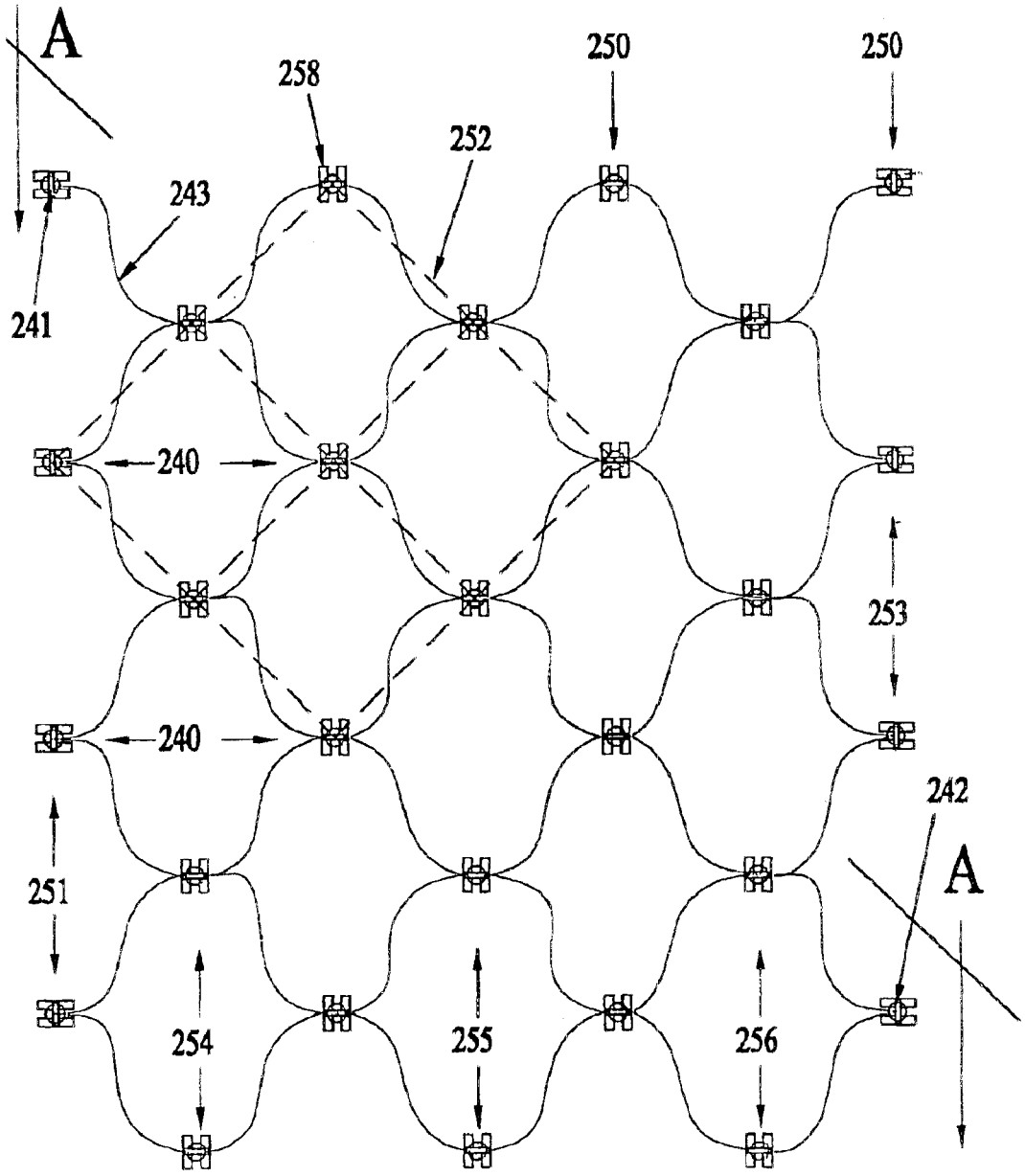
FIG. 24 shows the creation of a lattice of strands embodied in the invention.

Another aspect of the invention is shown in FIG. 23. The anchor plates can take a variety of shapes. One embodiment of the anchor plate is shown in FIG. 23A comprising a rectangular flat steel plate with a circular hole penetrating its centre to allow sliding movement over the head of the member. The hole also permits insertion of grouting tubes. The sides of the hole will engage with the crimped portion of the member. In FIG. 23B another embodiment of the anchor includes two additional holes to permit insertion of grouting tubes. In FIG. 23C another embodiment of the anchor plate is shown comprising a flat rectangular steel plate with a circular hole penetrating its centre and a solid steel dowel welded to the upper face of the plate. In using this embodiment, the hole is first grouted and the anchor 23C is placed over the grouted hole while the grout is still wet. A double-legged reinforcing member such a shown in FIG. 20 is inserted into the hole so that individual legs (206) and (208) straddle the dowel. The crimped portion of the member (204) is then pressed over the dowel so that the head (202) of the member surrounds the dowel. The grout quickly sets and the reinforcing member is retained within the hole. In FIG. 23D another embodiment of the anchor plate is shown comprising a rectangular flat steel plate (230) having a notch (232) and a solid steel dowel (234) welded to the closed end (236) of the steel plate. Using this embodiment, and referring to FIG. 22, member (200) is inserted into the hole and the hole is grouted. Once the hole is filled with grout the anchor plate (230) is slipped onto the head of the member so that the notched portion of the anchor plate (232) is adjacent to the crimped portion (204) of the member and the solid metal dowel slides into the head of the member thereby fixing the anchor plate to the member. Referring to FIG. 23E this embodiment of the anchor plate is the same as that shown in FIG. 23D except that the dowel is a hollow steel tube. The anchor is installed in the same manner as described above for the anchor 23D. Once instated, the hollow steel tube can be used to carry such things as cables. One example of this application is shown in FIG. 24. Referring to FIG. 23F another embodiment of the anchor plate is shown comprising two spaced apart and parallel rectangular steel members fastened together by a hollow steel dowel wherein the dowel is welded to each steel member at its opposite ends. In this embodiment as with the embodiment shown in FIG. 23C, the reinforcing member (200) is inserted into the drill hole so that the legs (206) and (208) straddle the dowel and the crimped portion (204) slides over the dowel so that the dowel sits within the head (202) of the member.

Another aspect of the invention is discussed with reference to FIGS. 20, 23, 24 and 25. Referring to FIG. 24, a reinforcing steel net can be woven to support a portion of rock wall or roof using a combination of reinforcing members and anchor plates previously described herein A plurality of rows (240) and columns (250) of drill holes are drilled into the rock body to be supported. The rows and columns of drill holes are offset from each other in such a way that together they form a diamond-lattice pattern (252) as shown in FIG. 24. The first column (251) of drill holes and the last column (253) of drill holes are identified. The remaining columns of drill holes (254, 255 and 256) are designated as intermediate drill holes. The intermediate drill holes are grouted one-by-one. Then anchor plates (258) of the types disclosed in FIG. 23E or 23F are placed over the mouth of the grouted drill hole. Then reinforcing members of the type disclosed in FIG. 20 are installed in each of the intermediate holes so the hollow dowels of the anchor plates are pressed into the heads of the members. To commence weaving of the steel net, a length of strand (243) is cut long enough to be woven and anchored between diagonal anchor holes (241) and (242). An anchor plate of the type shown in FIG. 23C or 23I) is placed over the grouted hole (241). The strand is inserted into the drill hole and the grout sets. The strand is curved around the solid dowel to avoid sharp bends and stresses. The free end of the strand is then diagonally woven through the hollow dowels of the anchor plates of the intermediate columns terminating at hole (242). Hole (242) is grouted. A metal anchor plate of the type shown in FIG. 23C or 23D is placed over the hole. The end of the strand is placed into the hole and the grout sets. In this way, the first strand of the net is in place. Additional strands are anchored and woven as desired until the net is complete.

Figure 25:
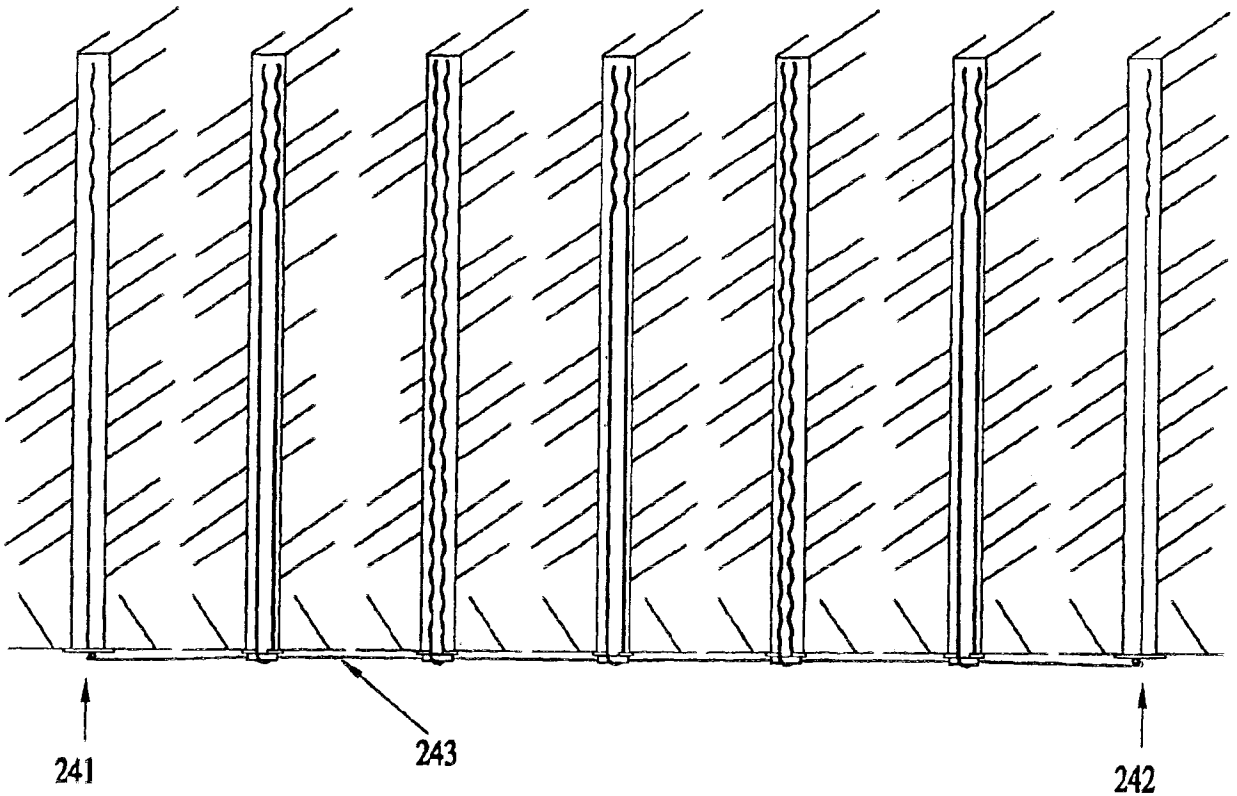
FIG. 25 shows a section view of FIG. 24.

Referring to FIG. 25, a profile along line A—A shown in FIG. 24 is illustrated. Holes (241) and (242) are the anchor holes for the strand (243). The strand is woven diagonally through the hollow dowels of the anchor plates of the intermediate holes.

Figure 26:
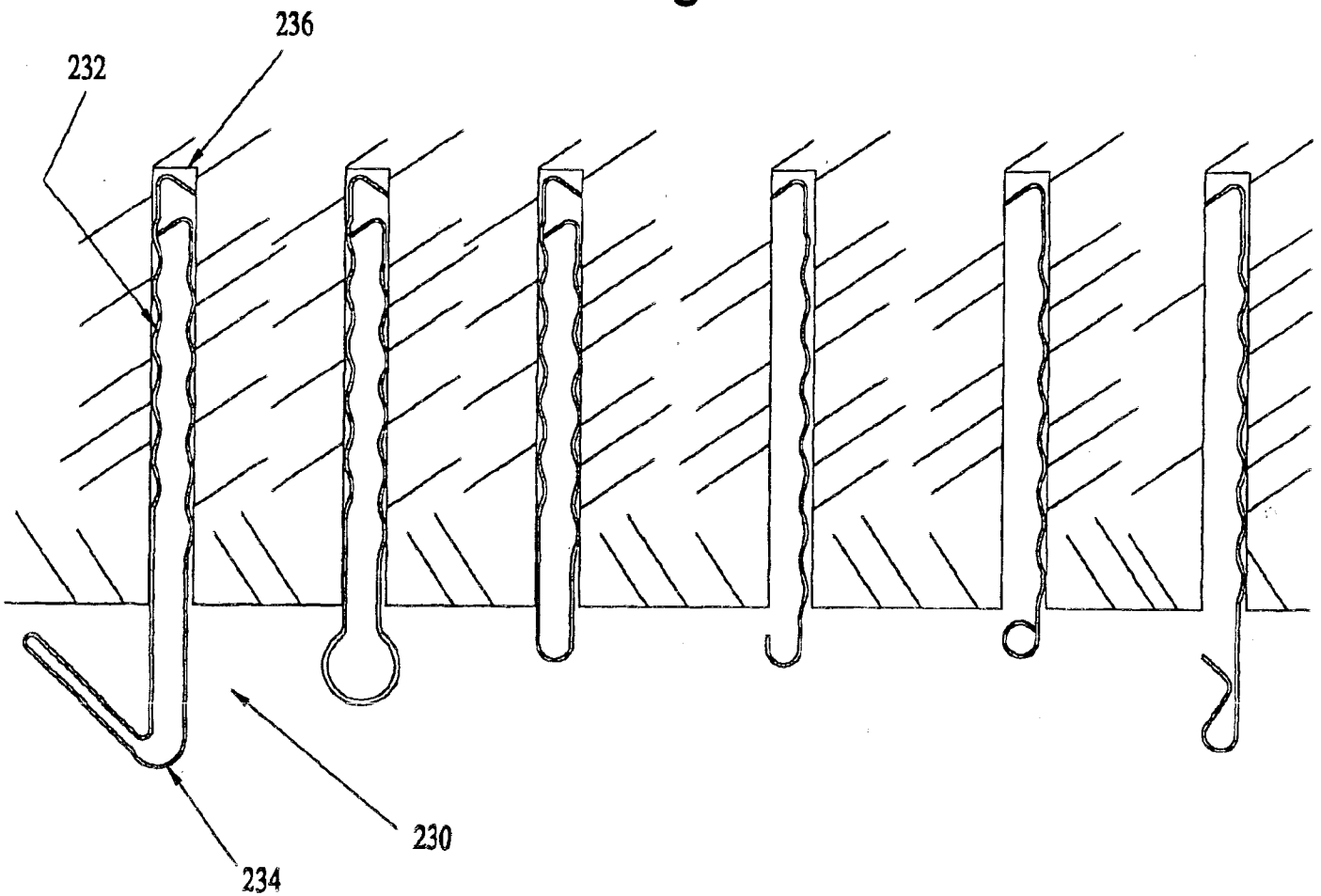
FIG. 26 shows in side sectional view a variety of rock hangers embodied in the invention.

Another aspect of the invention is shown in FIG. 26. A variety of shapes of rock hangers (230) can be fabricated from metal strand as shown. The rock hangers have bodies (232) and heads (234). The head extend from the drilled hole (236) and are adapted to support such things as electrical cable and pipes. Prior to inserting the rock hanger into the hole the hole is grouted with a cementacious grout or a resin grout as desired. The corrugated shape of the rock hanger holds the hanger in the hole until the grout sets. Alternatively, the rock can be drilled and the hangers inserted for later grouting. The corrugated shaped of the hanger body will act against the sides of the walls to hold the hanger in place until the holes are grouted.

The invention also includes a method for manufacturing reinforcing members comprising the steps of: providing a continuous source of suitable material for making members; establishing the desired length of the member; pressing the material into desired profiles; guiding the material into the drill hole; and, cutting the material into members of desired length.

The invention also includes a method for grouting members in a drill hole comprising the following steps: providing a supply of cementacious grouting material; providing tubing from the supply to the drill hole; connecting at least one pump between the supply and tubing to pump the grouting material from the supply through the tubing into the drill hole; pumping the desired amount of grout into the drill hole; severing the tubing at the mouth of the drill hole; and, inserting a wedge between the wall of the drill hole and the reinforcing members to hold the grout and the members in place until the grout sets.

The invention also includes a method for grouting a drill hole comprising the steps of providing a supply of binary polyester resin grout wherein each element of the binary resin is stored in its own reservoir; providing tubing from each reservoir to a mixing chamber; providing tubing from the mixing chamber into the drill hole; connecting a pump between each reservoir and tubing to force the resin into the mixing chamber and into the drill hole; pumping the desired amount of grout into the drill hole; and, severing the tube at the mouth of the drill hole. The entire drill hole may be filled with grout, or the toe of the drill hole may be filled with grout, or the toe and collar of the drill hole may be filled with grout.

Also included in the invention is a method of reinforcing a body of rock comprising the steps of drilling a predetermined number of off-set cooperating columns and rows of holes of a predetermined length in said body such the holes form a pattern resembling a diamond lattice; identifying the first vertical row of holes and the last vertical row of holes in the body; identifying the remaining intermediate rows of holes; grouting the intermediate rows of holes with a suitable grouting material; placing anchor plate over each of said grouted intermediate holes said anchor plates having a hollow dowel fixed thereto; inserting a reinforcing member into the grouted holes said member having a head, a crimped portion below said head and a pair of substantially parallel legs depending from said crimped portion, said legs of a predetermined length having a predetermined corrugated pattern, said legs straddling the dowel; pressing crimped portion of the member over the dowel such that the dowel is forced into the head of the member pushing a double-legged reinforcing member into each hole so that the legs straddle the anchor dowel and so that the head of the member is press-fit onto the dowel; and, permitting the grout to set.

The method of reinforcing a body of rock further comprises the steps of: identifying the top drill hole of the first row of drill holes; identifying the bottom drill hole of the last row of drill holes; grouting said top drill hole; placing an anchor over the top drill hole said anchor having a solid dowel fixed thereto; obtaining a strand of reinforcing material having a first end and a second end said strand being sufficiently long so that said first end will reach the toe of the first top drill hole and the second end will reach the toe of the bottom drill hole of the last row of drill holes; corrugating a predetermined length of the first end of the strand; inserting the first end of the strand into the grouted top hole so that the first end reaches the toe of the hole; bending the strand over the anchor dowel in the direction of the last drill hole; threading the strand through the hollow anchor dowels of the diagonal intermediate holes between the first and last hole; grouting the last hole; placing an anchor plate over the grouted last hole; corrugating a predetermined length of the end of the strand; placing the end of the strand into the last hole so that the end of the strand reaches the toe of the last hole; and, permitting the grout to set.

The method of reinforcing a rock body further comprises the steps of selecting the next top hole down in the first row of holes; selecting the next bottom hole up in the last row of holes; repeating the steps noted above.

Although the description above contains many specifications, these should not be construed as limiting the scope of the invention but as merely providing illustrations of some of the presently preferred embodiments of this invention. Thus the scope of the invention should be determined by the appended claims and their legal equivalents rather than by the examples given.

What is claimed is:

1. A mobile system for manufacturing and installing reinforcing members in a drill hole said system comprising:

a. a mobile platform adapted for movement within a tunnel;

b. means for manufacturing and installing said members said means mounted to the mobile platform, wherein said means for manufacturing members comprises:
   i. a source of material suitable for making members;
   ii. means for motivating said material from the source to a drill hole;
   iii. a device for measuring material linearly;
   iv. a crimping device for shaping material;
   v. means for guiding the material into a drill hole; and
   vi. a cutter for cutting the material into members of desired lengths;

c. means for grouting said members within drilled holes said grouting means dismountably mounted to the mobile platform;

d. a power supply to drive the system; and e. means for controlling the system.

2. The system as claimed in claim 1 wherein said material comprises a continuous strand of one of: metal, fibreglass, plastic, Kevlar®, or composite materials.

3. The system as claimed in claim 2 wherein the material is steel strand having a suitable diameter and tensile strength.

4. The system as claimed in claim 2 wherein the continuous strand of material is rolled onto a spool rotatably mounted in a platform fixed storage rack for dispensing said material.

5. The system as claimed in claim 4 wherein additional spools of material are stored on the platform.

6. The system as claimed in claim 1 wherein said motivating means comprises two opposing pairs of rollers in frictional engagement with the material.

7. The system as claimed in claim 6 wherein each pair of rollers comprises two axially parallel, spaced apart and tandem-aligned rollers mounted on axles for rotational movement.

8. The system as claimed in claim 7 wherein each roller comprises a hub and elastomeric outer ring mounted circumferentially to said hub for frictional engagement with the material.

9. The system as claimed in claim 8 wherein a connecting member connects the axles of each pair of rollers said connecting member maintaining the connected axles in alignment during operation and distributing compressive loads equally across each roller pair.

10. The system as claimed in claim 9 further comprising a biasing means operatively connected to at least one connecting member said biasing means comprising a shuttle adapted to move said connected member towards or away from the opposing pair of rollers hence controlling compressive loads and frictional engagement between the rollers and the material.

11. The system as claimed in claim 10 wherein said biasing means comprises a shuttle; said shuttle operatively attached to the connecting member and adapted to retract or advance the connecting member as required.

12. The system as claimed in claim 11 wherein said shuttle comprises a hydraulic cylinder and a piston; said piston attached to the connecting arm.

13. The system as claimed in claim 11 wherein said shuttle comprises a motorized worm gear said worm gear attached to the connecting arm.

14. The system as claimed in claim 11 wherein said shuttle comprises a motorized rack and pinion gear said rack attached to the connecting arm.

15. The system as claimed in claim 11 wherein said biasing means is logically connected to said control means and remotely controllable by an operator.

16. The system as claimed in claim 15 wherein at least one roller is driven by a motor.

17. The system as claimed in claim 16 wherein said motor is a hydraulic motor.

18. The system as claimed in claim 16 wherein the motor is an electric motor.

19. The system as claimed in claim 16 wherein said driven roller includes a co-axial parallel mounted pulley adapted to receive a drive belt from the motor.

20. The system as claimed in claim 16 wherein the driven roller includes a co-axial parallel mounted sprocket gear adapted to receive a drive chain from the motor.

21. The system as claimed in claim 16 wherein the driven roller is co-axially mounted to the shaft of the motor.

22. The system as claimed in claim 16 wherein the driven roller drives its paired roller said driven roller including a second parallel co-axially mounted pulley for receiving a drive belt from its paired roller said paired roller having a parallel co-axially mounted pulley for receiving a drive belt from said driven roller.

23. The system as claimed in claim 16 wherein said driven roller includes a second co-axially mounted sprocket gear adapted to receive a drive chain from its paired roller and the paired roller includes a co-axially mounted sprocket gear adapted to receive a drive chain from the driven roller.

24. The system as claimed in claim 1 wherein said crimping device comprises:

a. a pair of opposed, counter-rotating, axle-mounted wheels wherein said axles are in vertical alignment and wherein said wheels include a plurality of radial-spaced convex-shaped cogs around their circumference;

b. a shuttle operatively connected to at least one axle said shuttle adapted to vertically move the connected axle to and from the opposing axle so that the cogs can disengage, engage and intermesh to a predetermined depth; and, c. a drive motor connected to at least one driven wheel for simultaneously driving both wheels in rotation wherein said drive motor is adapted to accommodate the movement of the shuttle.

25. The system as claimed in claim 24 wherein material is directed between the intermeshing cogs in order to receive a desired corrugated profile.

26. The system as claimed in claim 25 wherein the shuttle comprises a hydraulic cylinder and piston; said piston attached to one axle and capable of moving said axle vertically.

27. The system as claimed in claim 26 wherein said driven wheel includes a parallel co-axially mounted sprocket gear adapted to receive a drive chain from the motor.

28. The system as claimed in claim 26 wherein the shaft of the motor is directly coupled to the driven wheel axle.

29. The system as claimed in claim 26 wherein the motor is adapted to drive both wheels simultaneously and adjust for vertical movement between them.

30. The system as claimed in claim 29 wherein distance between the wheels is remotely controlled remotely by an operator.

31. The system as claimed in claim 30 wherein the operation of the wheels is logically connected to the operation of the motivating device so that when the wheels are engaged the motivating means is disengaged and when the motivating means is engaged the wheels are disengaged.

32. The system as claimed in claim 1 wherein said guiding means comprises:

a. a hydraulic articulating arm having a one end free and the other end pivotally mounted the platform;

b. a guide head fixed to the free end of the arm for guiding material into a drill hole; and, c. a guide tube mounted to the arm for receiving material from the platform and guiding it into the guide head.

33. The system as claimed in claim 32 wherein said guide head comprises a "C" shaped frame for fixedly supporting a guide funnel for guiding the material into the drill hole said frame having a lower leg said lower leg having an upper and lower surface, said lower leg apertured, a parallel upper leg and a vertical leg connecting said upper and lower legs.

34. The system as claimed in claim 33 wherein said guide funnel is fixed to the upper leg said funnel having a body for receiving material from the guide tube and a guide spout for guiding the material from the body into the drill hole.

35. The system as claimed in claim 34 wherein the guide tube is fixed to and penetrates the lower leg of the frame permitting material to move up the guide tube, through the lower leg of the frame and emerge within the guide frame.

36. The system as claimed in claim 1 wherein the cutter is fixed to the upper surface of the lower leg of the frame and comprises:

a. a rectangular body;

b. a bevelled chevron-shaped blade attached to said body said shape giving stability to the material while being cut;

c. a cutting block adjacent to the blade against which the material is pressed and cut by shear forces; and, d. a shuttle operatively connected to said blade for imparting a to and fro motion to the blade.

37. The system as claimed in claim 36 wherein said shuttle is an electric solenoid.

38. The system as claimed in claim 36 wherein said shuttle is a hydraulic piston.

39. The system as claimed in claim 36 wherein said cutting block comprises a front face and an upper surface; said upper surface having a rectangular hollow; said hollow having a front inclined wall for receiving cut members and a vertical back wall for retaining cut members in the hollow.

40. The system as claimed in claim 39 wherein the blade has a first disengaged position away from the material; a second cutting position wherein the cutter presses the material against the vertical face of the cutting block inducing sufficient shear forces to cut the material; and a third position wherein the cutter pushes the cut member into the hollow.

41. The system as claimed in claim 40 wherein the cutter is remotely controlled by an operator.

42. The system as claimed in claim 41 wherein the cutter is programmable to cut members of predetermined lengths.

43. A mobile system for manufacturing and installing reinforcing members in a drill hole said system comprising:

a. a mobile platform adapted for movement within a tunnel;

b. means for manufacturing and installing said members said means mounted to the mobile platform;

c. means for grouting said members within drilled holes said grouting means dismountably mounted to the mobile platform, wherein said grouting means comprises:

i. a cementacious grout mixing chamber said chamber having mixing blades powered by a hydraulic motor;

ii. tubing to transfer mixed cementacious grout from the mixing chamber to the drill hole;

iii. at least one pump between attached between the mixing chamber and the tubing to force the cementacious grout into the drill hole; and iv. a plug to insert into the grouted hole to maintain the members and the grout in the hole:

d. a power supply to drive the system; and e. means for controlling the system.

44. The system as claimed in claim 43 wherein the plug is wedge shaped.

45. The system as claimed in claim 43 wherein the plug is cone shaped.

46. The system as claimed in claim 43 wherein the grouting means is fixed to a dismountable base on the platform for movement from the platform to the ground.

47. A mobile system for manufacturing and installing reinforcing members in a drill hole said system comprising:

a. a mobile platform adapted for movement within a tunnel;

b. means for manufacturing and installing said members said means mounted to the mobile platform;

c. means for grouting said members within drilled holes said grouting means dismountably mounted to the mobile platform, wherein said grouting means comprises:

i. two reservoirs mounted to the platform each reservoir holding one element of a binary resin grouting material;

ii. tubing to transfer said binary elements to a mixing chamber;

iii. tubing to transfer the mixed resin from said mixing chamber into the drill hole; and iv. one pump connected to each reservoir for pumping the binary elements to the mixing chamber and into the drill hole;

d. a power supply to drive the system; and e. means for controlling the system.

48. The system as claimed in claim 47 wherein the grouting means is fixed to a dismountable based on the platform for movement from the platform to the ground.

49. A mobile system for manufacturing and installing reinforcing members in a drill hole said system comprising:

a. a mobile platform adapted for movement within a tunnel;

b. means for manufacturing and installing said members said means mounted to the mobile platform;

c. means for grouting said members within drilled holes said grouting means dismountably mounted to the mobile platform;

d. a power supply to drive the system; and e. means for controlling the system, wherein said reinforcing member comprises a predetermined length of material having a head part adapted to extend from the drill hole, a body part adapted for insertion into the drill hole and a variable pattern of corrugations pressed into the body part.

50. The system as claimed in claim 49 wherein the member further includes a generally rectangular compressible metal body placed over the head of the member said body having a passage to receive the head of the member said body compressed by compression means so that it is permanently fixed to the head of the member.

51. The system as claimed in claim 50 wherein the body has a plurality of passages to receive a plurality of members.

52. The system as claimed in claims 50 or 51 wherein the member further includes an anchor plate said anchor plate apertured for placement onto the head of the member.

53. The system as claimed in claim 52 wherein the anchor plate is adapted to function as a hanger for hanging utilities and the like therefrom.

54. A mobile system for manufacturing and installing reinforcing members in a drill hole said system comprising:

a. a mobile platform adapted for movement within a tunnel;

b. means for manufacturing and installing said members said means mounted to the mobile platform;

c. means for grouting said members within drilled holes said grouting means dismountably mounted to the mobile platform;

d. a power supply to drive the system; and e. means for controlling the system, wherein the member comprises a head and a pair of substantially parallel legs depending from said head.

55. The system as claimed in claim 54 wherein the member further comprises a symmetrical crimped portion below the head.

56. The system as claimed in claims 54 or 55 wherein the legs have a predetermined length and predetermined pressed corrugated profiles to suit the reinforcement application.

57. The system as claimed in claim 56 further including an anchor plate fitted over the head of the member.

58. The system as claimed in claim 57 further including a dowel inserted through the head for fixing the anchor to the member.

59. The system as claimed in claim 58 wherein the dowel is solid.

60. The system as claimed in claim 59 wherein the dowel is hollow.

61. The system as claimed in claims 59 or 60 wherein the dowel is permanently fixed to the anchor plate.

62. The system as claimed in claim 61 wherein the dowel is adapted for hanging utilities and like there from.

63. A mobile system for manufacturing and installing reinforcing members in a drill hole said system comprising:

a. a mobile platform adapted for movement within a tunnel;

b. means for manufacturing and installing said members said means mounted to the mobile platform;

c. means for grouting said members within drilled holes said grouting means dismountably mounted to the mobile platform;

d. a power supply to drive the system, e. means for controlling the system; and f. a bending device mounted to the platform for bending members into desired shapes said device comprising:

i. a hydraulic cylinder operatively connected to a piston having a curved head for pressing the member into a desired shape; and ii. a pair of spaced apart shoulders opposite the piston head such that when the head of the piston is extended it is interposed between the two shoulders so that a member placed between the head and the shoulders will be pressed into a desired shape.

64. The system as claimed in claim 63 wherein said shoulders can be compressed together to further shape the heed of the member.

* * * * *